US010796522B2

(12) United States Patent
Crispino

(10) Patent No.: US 10,796,522 B2
(45) Date of Patent: Oct. 6, 2020

(54) ELECTRONIC GAMING MACHINE AND METHOD HAVING INDEPENDENTLY OPERABLE GAME DISPLAY WINDOWS FOR SINGLE OR MULTI-PLAYER PLAY

(71) Applicant: Aristocrat Technologies Australia Pty Limited, North Ryde (AU)

(72) Inventor: Oliver Crispino, Rosemeadow (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 0 days.

(21) Appl. No.: 16/122,788

(22) Filed: Sep. 5, 2018

(65) Prior Publication Data

US 2019/0073863 A1 Mar. 7, 2019

(30) Foreign Application Priority Data

Sep. 5, 2017 (AU) ..... 2017903582
Aug. 29, 2018 (AU) ..... 2018222966

(51) Int. Cl.
*G07F 17/12* (2006.01)
*G07F 17/32* (2006.01)
*G07F 17/34* (2006.01)

(52) U.S. Cl.
CPC ..... *G07F 17/3213* (2013.01); *G07F 17/3267* (2013.01); *G07F 17/3269* (2013.01); *G07F 17/3265* (2013.01); *G07F 17/34* (2013.01)

(58) Field of Classification Search
None
See application file for complete search history.

(56) References Cited

U.S. PATENT DOCUMENTS

2008/0108411 A1* 5/2008 Jensen ..... G07F 17/32 463/20
2010/0197385 A1 8/2010 Aoki et al.
2014/0256411 A1* 9/2014 Basallo ..... G07F 17/3267 463/25

* cited by examiner

*Primary Examiner* — Damon J Pierce
(74) *Attorney, Agent, or Firm* — McAndrews, Held & Malloy, Ltd.

(57) ABSTRACT

An electronic gaming machine and method having independently operable game display windows comprising independent displays and controls to play a game individually or as a group game between or among players. The electronic gaming machine comprises a video display and a game controller configured to display on the video display a first set of reels and a second set of reels, control the video display to initially synchronously spin pairs of first and second reels to a stop, and, upon a potential trigger condition being met, control the video display to asynchronously spin pairs of first and second reels to a stop. The game controller is further configured to control the video display to move a special symbol on the video display in a direction opposite to an evaluation direction towards an evaluated position.

18 Claims, 15 Drawing Sheets

ELECTRONIC GAMING MACHINE AND METHOD HAVING INDEPENDENTLY OPERABLE GAME DISPLAY WINDOWS FOR SINGLE OR MULTI-PLAYER PLAY

RELATED APPLICATIONS

This application claims priority to Australian Patent Application No. AU2017903582, having a filing date of Sep. 5, 2017 and to Australian Patent Application No. AU2018222966, having a filing date of Aug. 29, 2018, which is incorporated herein by reference in its entirety.

BACKGROUND

The present disclosure relates to a gaming machine and a method of operating a gaming machine.

Gaming machines are known where a single player can play multiple simultaneous games. U.S. Pat. No. 6,652,378 to Cannon et al, describes an arrangement where windows are added to a gaming machine so that there are separate windows for each of the games being played by the player and the number of windows displayed at any time is dependent on player selections. A need exists for alternative gaming machine.

BRIEF SUMMARY

In a first aspect, the disclosure provides an electronic gaming machine comprising a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a pay table defining awards for winning combinations of symbols applicable to each of the first and second sets of columns of symbol display positions; and a game controller configured to: operate in a one-player mode or a two-player mode responsive to at least one instruction input to the gaming machine; control, when operating in either the one-player mode or a two-player mode, each reel of the first and second sets of reels to spin to a respective stop position to thereby select, at the conclusion of the spinning, symbols that fill the columns of symbol display positions; and in the two-player mode: evaluate the symbols displayed in the first set of columns of symbol display positions based on the pay table and make any awards for winning combinations of symbols to a first player; evaluate the symbols displayed in the second set of columns of symbol display positions based on the pay table and make any awards for winning combinations of symbols to a second player; evaluate the symbols displayed in the first and second sets of columns of symbol display positions to determine whether a trigger condition is met; and upon the trigger condition being met, conduct additional game play corresponding to the trigger condition for each of the first and second players; or in the one-player mode: evaluate at least the symbols displayed in the first set of columns of symbol display positions based on the pay table and make any awards for winning combinations of symbols to the first player; evaluate the symbols displayed in the first and second sets of columns of symbol display positions to determine whether a trigger condition is met; and upon the trigger condition being met, conduct additional game play corresponding to the trigger condition for the first player.

In an embodiment, the game controller is responsive to an additional instruction in the one-player mode to also evaluate the symbols displayed in the second set of columns of symbol display positions based on the pay table and make any awards for winning combinations of symbols to the first player.

In an embodiment, the gaming machine comprises a plurality of buttons for inputting instructions into the electronic gaming machine.

In an embodiment, the plurality of buttons comprise virtual buttons displayed on a touch screen display of the gaming machine.

In an embodiment, the plurality of buttons comprise reconfigurable physical buttons.

In an embodiment, the plurality of buttons include at least one button operable to select between the one-player mode and the two-player mode.

In an embodiment, in the two-player mode, the plurality of buttons include buttons to enable each of the first and second players to independently specify one of a plurality of different wager amounts to apply to symbols displayed in the first and second sets of columns of symbol display positions respectively.

In an embodiment, in the one-player mode, the plurality of buttons include buttons to enable the first player to independently specify one of a plurality of different wager amounts to apply to symbols displayed in the first and second sets of columns of symbol display positions respectively, and wherein one button corresponds to a zero wager in respect of one of the first and second sets of columns of symbol display positions.

In an embodiment, the game controller is configured so that in the one-player mode, the gaming machine defaults to activating the button corresponding to a zero wager.

In an embodiment, the button corresponding to a zero wager is associated with the second set of symbol display positions.

In an embodiment, the symbol set comprises at least one symbol that can occupy more than one symbol display position and that is evaluated as individual instances of that symbol in respect of each symbol display position occupied.

In a second aspect, the disclosure provides a method of operating an electronic gaming machine comprising a first set of reels corresponding to a first set of columns of symbol display positions, each first reel comprising a plurality of symbols of a symbol set, a second set of reels corresponding to a second set of columns of symbol display positions, each second reel comprising a plurality of symbols of the symbol set, a memory storing a pay table defining awards for winning combinations of symbols applicable to each of the first and second sets of columns of symbol display positions, and a game controller configured to operate in a one-player mode or a two-player mode responsive to at least one instruction input to the gaming machine. The method comprises controlling, when operating in either the one-player mode or a two-player mode, each reel of the first and second sets of reels to spin to a respective stop position to thereby select, at the conclusion of the spinning, symbols that fill the columns of symbol display positions. The method also includes in the two-player mode: evaluating the symbols displayed in the first set of columns of symbol display positions based on the pay table and make any awards for winning combinations of symbols to a first player, evaluating the symbols displayed in the second set of columns of symbol display positions based on the pay table and make any awards for winning combinations of symbols to a second player, evaluating the symbols displayed in the first and second sets of columns of symbol display positions to determine whether a trigger condition is met, and upon the trigger condition being met, conducting additional game play corresponding to the trigger condition for each of the first and second players. The method also includes in the one-player mode: evaluating at least the symbols displayed in the first set of columns of symbol display positions based on the pay table and make any awards for winning combinations of symbols to the first player, evaluating the symbols displayed in the first and second sets of columns of symbol display positions to determine whether a trigger condition is met, and upon the trigger condition being met, conducting additional game play corresponding to the trigger condition for the first player.

In a third aspect, the disclosure provides an electronic gaming machine comprising: a first set of reels corresponding to a first set of columns of symbol display positions, each first reel comprising a plurality of symbols of a symbol set; and a second set of reels corresponding to a second set of columns of symbol display positions, each second reel comprising a plurality of symbols of the symbol set; and a memory storing a pay table defining awards for winning combinations of symbols applicable to each of the first and second sets of columns of symbol display positions; a plurality of buttons including first buttons to enable a first wager to be selected from one of a first plurality of different positive credit value wager amounts, the first wager applying to symbols displayed in the first set of columns of symbol display positions, and second buttons to enable a second wager amount to be selected from a zero amount and one of a second plurality of positive credit value wager amounts, the second wager applying to symbols displayed in the second set of columns of symbol display positions; a game controller configured to: control, irrespective of the wagers applied to each of the first and second sets of columns, each reel of the first and second sets of reels to spin to a respective stop position to thereby select, at the conclusion of the spinning, symbols that fill the columns of symbol display positions; evaluate the symbols displayed in the first set of columns of symbol display positions based on the pay table and the first wager, and make any awards for winning combinations of symbols; and evaluate the symbols displayed in the second set of columns of symbol display positions based on the pay table and the second wager, and make any awards for winning combinations of symbols, wherein a zero wager amount results in no award.

In an embodiment, the game controller is configured to evaluate the symbols displayed in the first and second sets of columns of symbol display positions to determine whether a trigger condition is met; and upon the trigger condition being met, conduct additional game play corresponding to the trigger condition.

In a fourth aspect, the disclosure provides a method of operating an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a pay table defining awards for winning combinations of symbols applicable to each of the first and second sets of columns of symbol display positions; and a plurality of buttons including first buttons to enable a first wager to be selected from one of a first plurality of different positive credit value wager amounts, the first wager applying to symbols displayed in the first set of columns of symbol display positions, and second buttons to enable a second wager amount to be selected from a zero amount and one of a second plurality of positive credit value wager amounts, the second wager applying to symbols displayed in the second set of columns of symbol display positions. The method comprises controlling, irrespective of the wagers applied to each of the first and second sets of columns, each reel of the first and second sets of reels to spin to a respective stop position to thereby select, at the conclusion of the spinning, symbols that fill the columns of symbol display positions; evaluating the symbols displayed in the first set of columns of symbol display positions based on the pay table and the first wager, and make any awards for winning combinations of symbols; and evaluating the symbols displayed in the second set of columns of symbol display positions based on the pay table and the second wager, and make any awards for winning combinations of symbols, wherein a zero wager amount results in no award.

In an embodiment, the method comprises: evaluating the symbols displayed in the first and second sets of columns of symbol display positions to determine whether a trigger condition is met; and upon the trigger condition being met, conducting additional game play corresponding to the trigger condition.

In a fifth aspect, the disclosure provides an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a pay table defining awards for winning combinations of symbols applicable to each of the first and second sets of columns of symbol display positions; a plurality of buttons including first buttons to enable a first wager to be selected from one of a plurality of different first wager amounts, the first wager applying to symbols displayed in the first set of columns of symbol display positions, and second buttons to enable a second wager amount to be selected from a plurality of second wager amounts, the second wager applying to symbols displayed in the second set of columns of symbol display positions; and a game controller configured to: control, irrespective of the wagers applied to each of the first and second sets of columns, each reel of the first and second sets of reels to spin to a respective stop position to thereby select, at the conclusion of the spinning, symbols that fill the columns of symbol display positions; evaluate the symbols displayed in the first set of columns of symbol display positions based on the pay table and the first wager, and make any awards for winning combinations of symbols; evaluate the symbols displayed in the second set of columns of symbol display positions based on the pay table and the second wager, and make any awards for winning combinations of symbols; evaluate the symbols displayed in the first and second sets of columns of symbol display positions to determine whether a trigger condition is met; and upon the trigger condition being met, conduct additional game play corresponding to the trigger condition.

In a sixth aspect, the disclosure provides a method of operating an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; and a memory storing a pay table defining awards for winning combinations of symbols applicable to each of the first and second sets of columns of symbol display positions;

and a plurality of buttons including first buttons to enable a first wager to be selected from one of a plurality of different first wager amounts, the first wager applying to symbols displayed in the first set of columns of symbol display positions, and second buttons to enable a second wager amount to be selected from a plurality of second wager amounts, the second wager applying to symbols displayed in the second set of columns of symbol display positions. The method comprises controlling, irrespective of the wagers applied to each of the first and second sets of columns, each reel of the first and second sets of reels to spin to a respective stop position to thereby select, at the conclusion of the spinning, symbols that fill the columns of symbol display positions; evaluating the symbols displayed in the first set of columns of symbol display positions based on the pay table and the first wager, and make any awards for winning combinations of symbols; evaluating the symbols displayed in the second set of columns of symbol display positions based on the pay table and the second wager, and make any awards for winning combinations of symbols; evaluating the symbols displayed in the first and second sets of columns of symbol display positions to determine whether a trigger condition is met; and upon the trigger condition being met, conducting additional game play corresponding to the trigger condition.

In a seventh aspect, the disclosure provides an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a) a pay table defining awards for winning combinations of symbols applicable to each of the first and second sets of columns of symbol display positions, and b) a plurality of meters; and a game controller configured to operate in a one-player mode or a two-player mode responsive to at least one instruction input to the gaming machine, control the display to display at least a subset of the meters, and respond to switching between the one-player mode and the two-player mode by changing the display of the at least a subset of the meters on the display.

In an embodiment, the controller changes the appearance of at least one of the meters.

In an embodiment, the controller adds at least one meter or removes at least one meter from the meters displayed on the display.

In an eighth aspect, the disclosure provides a method of operating an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a) a pay table defining awards for winning combinations of symbols applicable to each of the first and second sets of columns of symbol display positions, and b) a plurality of meters. The method comprising: operating in a one-player mode or a two-player mode responsive to at least one instruction input to the gaming machine, controlling the display to display at least a subset of the meters, and responding to switching between the one-player mode and the two-player mode by changing the display of the at least a subset of the meters on the display.

In a ninth aspect, the invention provides an electronic gaming machine comprising: a processor; a first set of reels corresponding to a first set of columns of symbol display positions, each first reel comprising a plurality of symbols of a symbol set; and a second set of reels corresponding to a second set of columns of symbol display positions, each second reel comprising a plurality of symbols of the symbol set and each second reel being paired with a first reel; and a memory storing a potential trigger condition and instructions which when executed cause the processor to: initially synchronously spin pairs of first and second reels to a stop; upon a potential trigger condition being met, asynchronously spin pairs of first and second reels to a stop.

In an embodiment, when the instructions are executed by the processor, the instructions cause the processor to: upon a trigger condition being met, award a feature game.

In a tenth aspect, the invention provides a method of operating an electronic gaming machine comprising a first set of reels corresponding to a first set of columns of symbol display positions, each first reel comprising a plurality of symbols of a symbol set, a second set of reels corresponding to a second set of columns of symbol display positions, each second reel comprising a plurality of symbols of the symbol set and each second reel being paired with a first reel, and a memory storing a potential trigger condition, the method comprising: initially synchronously spinning pairs of first and second reels to a stop; upon a potential trigger condition being met, asynchronously spinning pairs of first and second reels to a stop.

In an eleventh aspect, the invention provides an electronic gaming machine comprising: a display; a processor; and a memory storing a first set of columns of symbol display positions, an evaluation direction of the columns of symbol display positions that defines an evaluation order from a first evaluated column to a last evaluated column of the first set of columns, and instructions which when executed cause the processor to: initially control the display to display a special symbol at symbol positions of the last evaluated column; during a series of free games, move the special symbol in a direction opposite to the evaluation direction towards the first evaluated position; and evaluate each of the free games based on symbols selected in the respective free games, the current position of the special symbol and the evaluation order.

In an embodiment, the memory stores a second set of columns of symbol display positions comprising a first evaluated column to a last evaluated column of the second set of columns, and wherein when the instructions are executed they cause the processor to: display the second set of columns of symbol position next to the first set of symbol positions; and move the special symbol across both the first and second sets of symbol positions such that the special symbol is moved from the first evaluated column of the first set of columns of symbol positions to the last evaluated column of the second set of columns of symbol positions.

In an embodiment, the special symbol is a wild symbol.

In a twelfth aspect the invention provides a method of operating a gaming machine comprising a display and a memory storing a first set of columns of symbol display positions, and an evaluation direction of the columns of symbol display positions that defines an evaluation order from a first evaluated column to a last evaluated column of the first set of columns, the method comprising: initially displaying a special symbol at symbol positions of the last evaluated column; during a series of free games, moving the special symbol in a direction opposite to the evaluation direction towards the first evaluated position; and evaluating each of the free games based on symbols selected in the respective free games, the current position of the special symbol and the evaluation order.

In a thirteenth aspect, the disclosure provides a computer program code which when executed implements one or more of the above methods.

In a fourteenth aspect, the disclosure provides a tangible computer readable medium comprising the above program code.

BRIEF DESCRIPTION OF SEVERAL VIEWS OF THE DRAWINGS

An exemplary embodiment of the disclosure will now be described with reference to the accompanying drawings in which.

DETAILED DESCRIPTION

Figure 1:
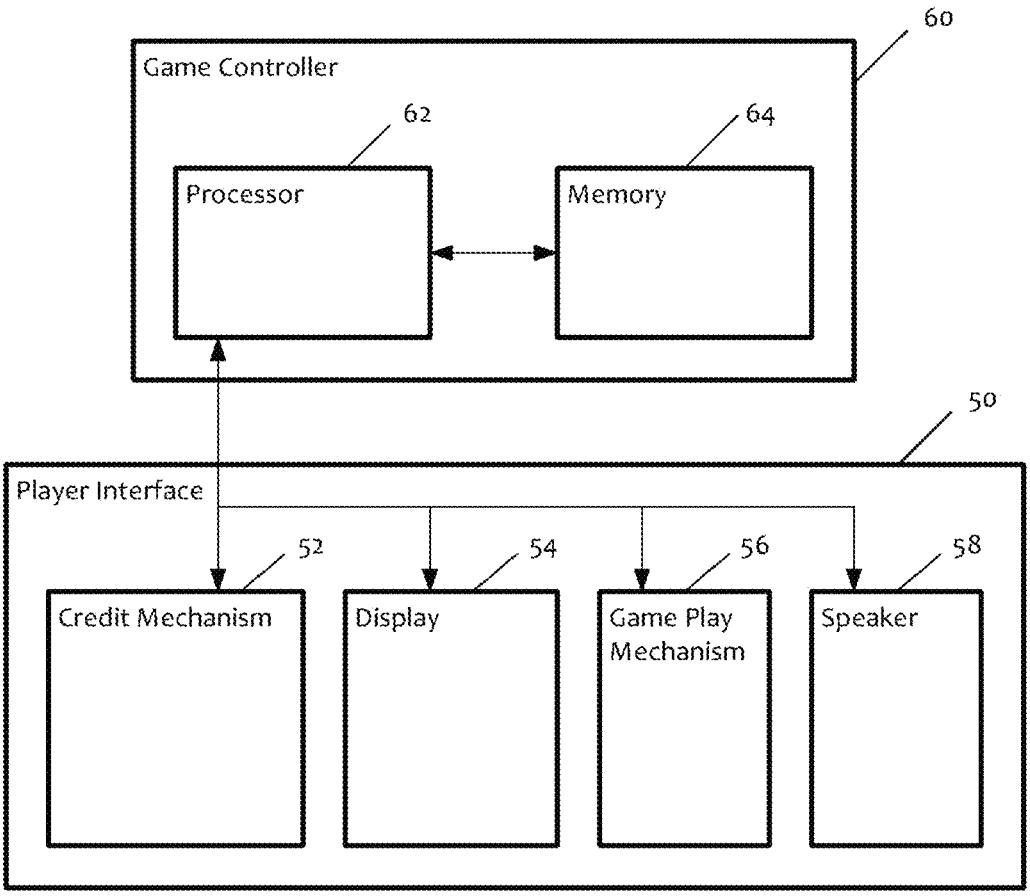
FIG. 1 is a block diagram of the core components of a gaming system.

Referring to the drawings, there is shown a gaming machine that is operable in a one-player mode and a two-player mode. The gaming machine has two sets of reels which are spun each time the game is played. In an embodiment, this allows the symbols spun up on both sets of reels to be evaluated to determine whether they individually or collectively trigger further game play irrespective of whether the gaming machine is being played in the one-player mode or the two-player mode. In an embodiment, the player(s) can wager different amounts in respect of each set of reels. In an embodiment, in the one-player mode, the player has the option to wager zero credits in respect of one of the sets of reels whereby otherwise winning outcomes on this set of reels result in no awards. The gaming machine having a game controller having components that enable the implementation of a game The gaming machine has several core components. At the broadest level, the core components are a player interface 50 and a game controller 60 as illustrated in FIG. 1. The player interface is arranged to enable manual interaction between one or two players and the gaming machine and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with program code stored in a memory 64 and outputs game play outcomes to the display. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
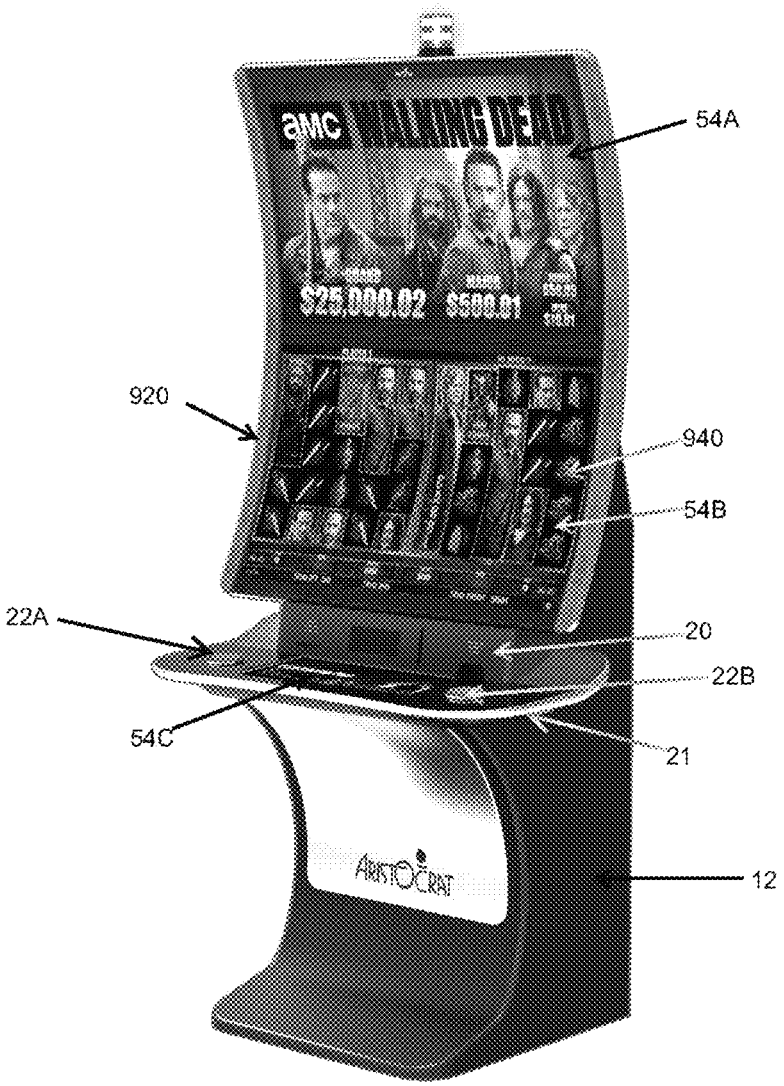
FIG. 2 is a perspective view of a gaming machine of an embodiment.

An example gaming machine 10 is illustrated in FIG. 2. The gaming machine 10 includes a console 12 having an upper display 54A and a lower display 54B on which are displayed representations of the game that is playable on the gaming machine. Table-top 21 of the gaming machine 10 provides the game play mechanism 56 in the form of a touch screen display 54C (shown in more detail in FIG. 6) and play buttons 22A, 22B which allow one or more players to start a play of the game. Mid-trim 20 houses a credit input mechanism which in this example includes a bill collector and a ticket reader. Mid-trim 20 also has a reading device provided for the purpose of reading a player tracking device, for example as part of a loyalty program.

The displays 54A, 54B, 54C shown in FIG. 2 are liquid crystal displays. The displays 54 may any other suitable video display unit, such as an OLED display.

Figure 6:
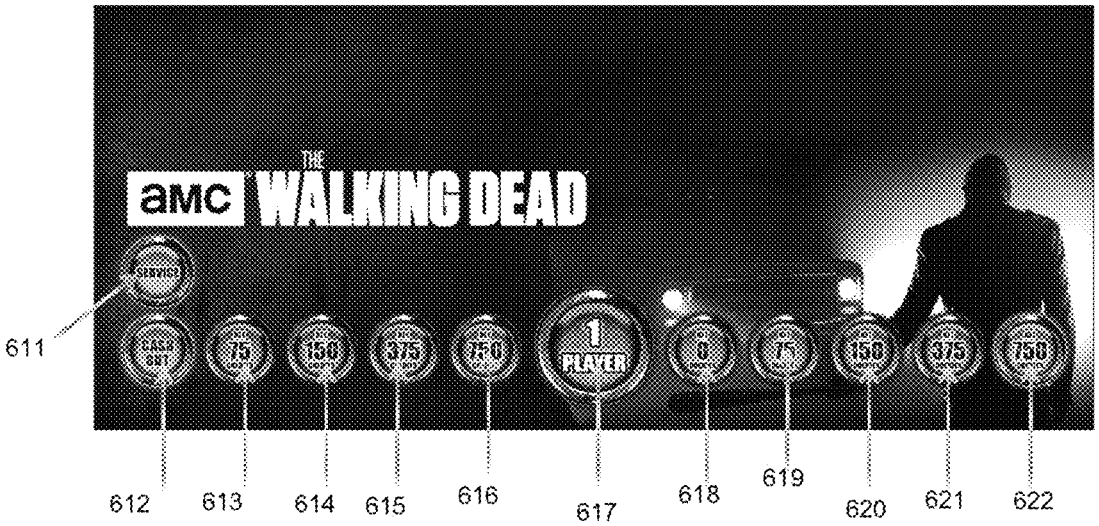
FIG. 6 illustrates an example of a game play mechanism of the gaming machine of FIG. 1.

Referring to FIG. 6, there is shown further detail of the touch screen display 54C that players use to input game play instructions. The touch screen display 54C displays a plurality of buttons 611 to 622. The buttons include service button 611 and cash out button 612. Mode selection button 617 allows players to select between single and two player modes. In FIG. 6, button 617 shows that the single player mode is active. Buttons 613 to 616 allow the player to select between four different positive credit value wagers to place on a first set of reels. Buttons 618 to 621 allow the player to select between five different wagers to place on a second set of reels including button 618 which allows the player to select a zero credit wager.

In another embodiment, the buttons are provided as physical buttons, for example, reconfigurable buttons that can indicate the difference in the manner they operate in dependence of the mode. For example, the buttons may incorporate a small display that indicates the function they perform.

Figure 3:
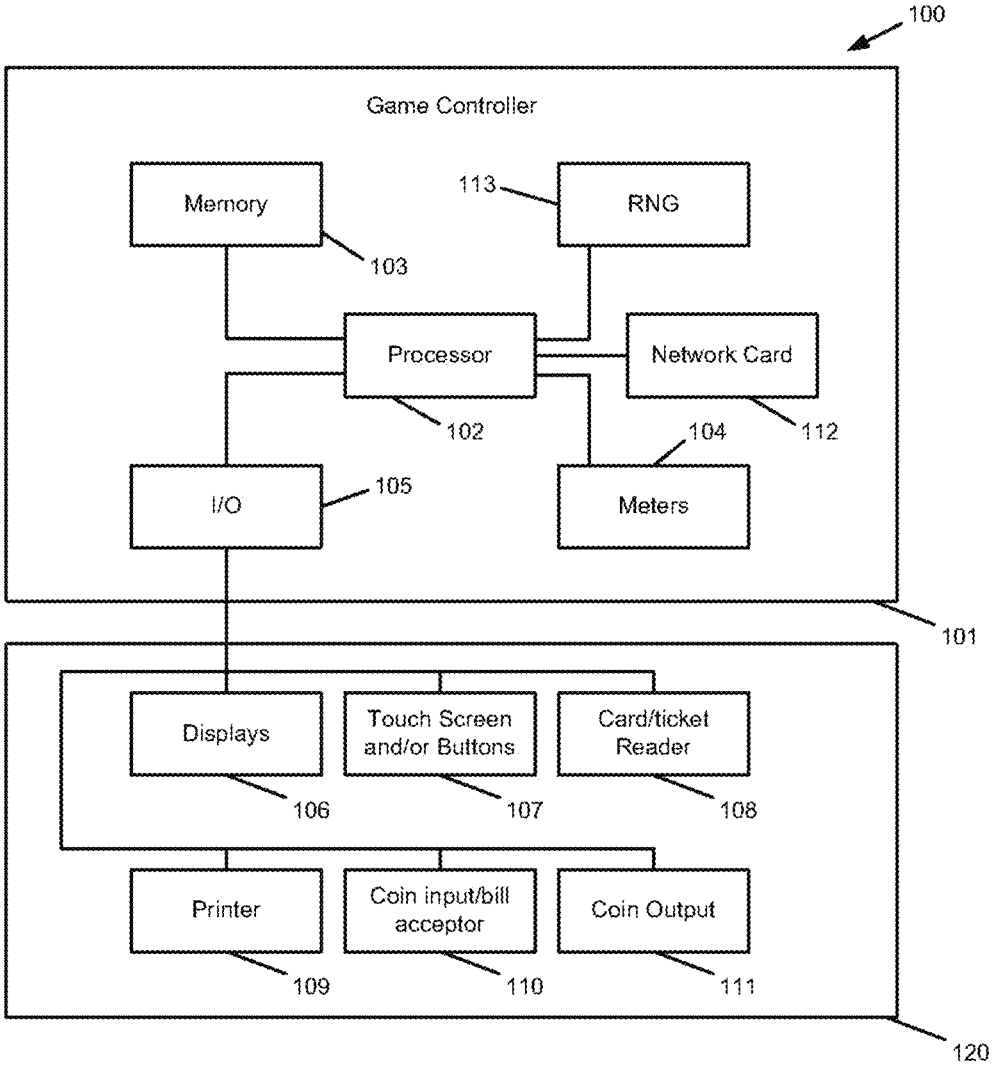
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. In some embodiments, the bill acceptor and/or coin input mechanism 110 may also function as a "ticket-in" reader that allows the player to use a casino issued credit ticket to load credits onto the gaming device 104A (e.g., in a cashless ticket ("TITO") system). In such cashless embodiments, the "ticket-out" printer 109 can be used for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using the ticket-out printer 109 on the gaming machine 100. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
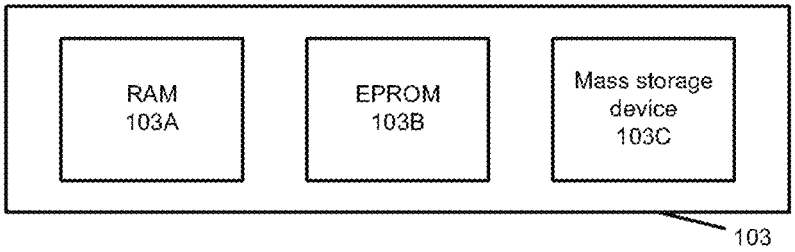
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices such as displays 106, touch screen and/or buttons 107, card and/or ticket reader 108, printer 109, bill acceptor and/or coin input mechanism 110, and coin output mechanism 111 to be provided remotely from the game controller 101.

Figure 5:
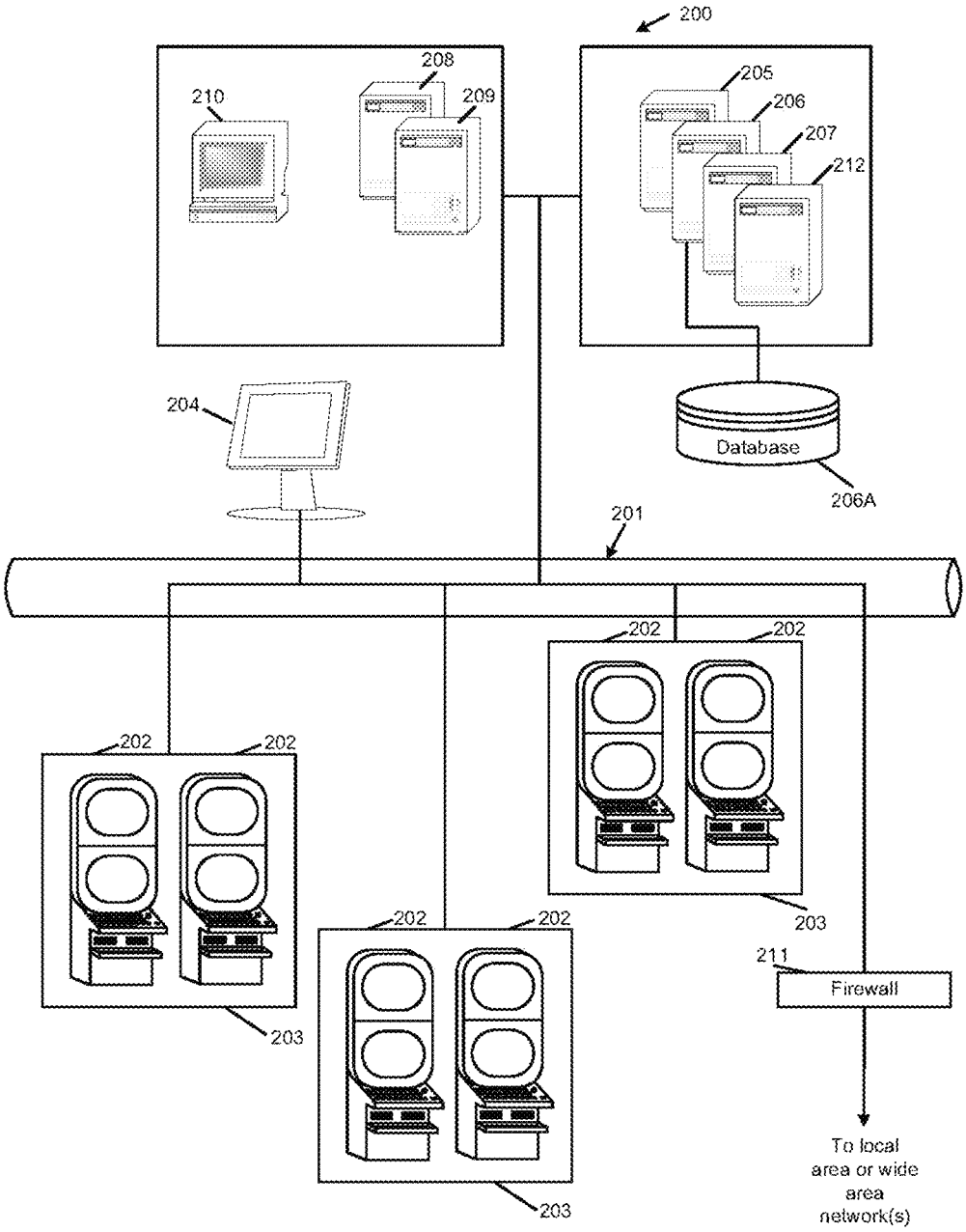
FIG. 5 is a schematic diagram of a gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 may be the same as the gaming machines 10, 100 shown in FIG. 2 or a number of different types of gaming machines. While banks 203 of two gaming machines are illustrated in FIG. 5, banks of one, three or more gaming machines are also envisaged.

Typically, if the gaming system enables players to participate in a Jackpot game, a Jackpot server 207 will be provided to perform accounting functions for the Jackpot game. A loyalty program server 212 may also be provided.

Servers are also typically provided to assist in the administration of the gaming system 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided.

Further Detail of Gaming System

A player or players operate the touch screen display 54C of game play mechanism 56 to specify wagers which will be evaluated for this play of the game. The player or players use the buttons 22A/22B to start a play of the game. In a two-player mode it may be necessary for the players to each press their respective button before the game starts.

Persons skilled in the art will appreciate that a player's wager can be varied from game to game dependent on player selections. In most spinning reel games, it is typical for the player's wager to be made up of a selection as to how the game outcome will be evaluated by specifying what parts of the game outcome will qualify for winning outcomes and a multiplier that will apply to each winning outcome.

Embodiments of the disclosure use an evaluation mechanic, based on the "Reel Power" mechanic developed by Aristocrat Leisure Industries Pty Ltd which is also known as a "ways" to win mechanic. In Reel Power games, the selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the center row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win. In embodiments of the disclosure, the player is required to wager on the maximum number of "ways" to win and hence the only variation is in the amount of credits wagered by player. This allows the wager options shown in FIG. 6 to be specified simply as wager amounts in credits to provide a simplified method for the player to select a wager. In another embodiment, the player may play a fixed number of pay lines. Such pay lines are formed by a combination of symbol display positions, one from each reel, the symbol display positions typically being located relative to one another such that they form a line.

In many games, the gaming machine may award winning outcomes which are not strictly limited to the lines they have selected, for example, "scatter" pays are awarded independently of a player's selection of pay lines. In embodiments of the disclosure, such scatter combinations are used as trigger symbols that result in additional game play as described in further detail below.

In the embodiment described below, the display positions of the symbol display are arranged in a rectangular matrix comprising a plurality of columns and a plurality of rows, for example, five columns and five rows, for each of two sets of reels (i.e. 10 columns and five rows in total). However, other arrangements are known in the gaming industry and could be employed in embodiments of the disclosure. For example, in some arrangements there are more symbols in some columns than others, such as 3-4-3-4-3 arrangement of seventeen display positions corresponding to respective ones of five reels. In such arrangements, the columns of four symbols can be arranged so that they are off-set or staggered relative to the columns having three symbols so that the middle two symbols in the columns of four symbols share boundaries with two symbols of each neighboring reel.

Figure 7:
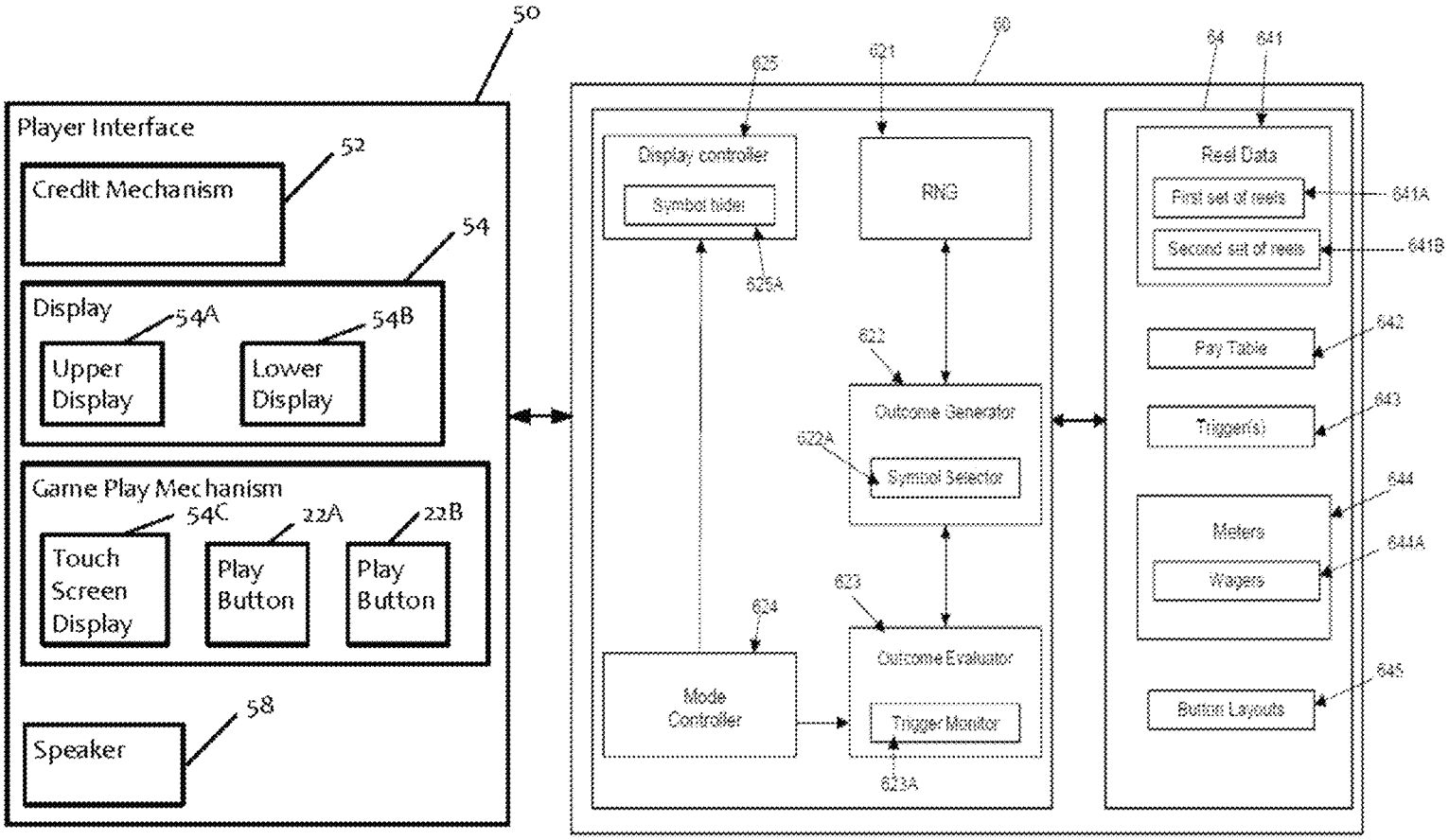
FIG. 7 is a further block diagram of the gaming machine.

In FIG. 7, the processor 62 of game controller 60 is shown implementing a number of modules based on program code and data stored in memory 64. Persons skilled in the art will appreciate that the modules could be implemented in some other way, for example by a dedicated circuit.

The player interface 50 comprises the credit mechanism 52, displays in the form of an upper display 54A and lower display 54B, the game play mechanism 56 in the form of the touch screen display 54C which displays virtual buttons and buttons 22A, 22B. The player interface also includes speakers 58.

The game controller 60 implements an outcome generator 622 which includes a single selector 622A which selects stopping positions for each reel of a first set of reels 641A and a second set of reels 641B stored in memory 64 as reel data 641. The symbol selector selects stopping positions by selecting for each reel a stopping position which corresponds to a specific position on a display. That is, each set of reels 641A, 641B corresponds to a set of symbol display positions. Each set of symbol display positions is formed from a plurality of columns of symbol display positions which is apparent from reviewing, for example FIG. 9. In embodiments of the disclosure, the first set of reels and second set of reels derive from the same set of symbols and include some symbols that act as trigger symbols. The distribution of trigger symbols across the first and second sets reels is designed to ensure that trigger conditions have the desired probability.

The game controller has an outcome evaluator 623 which evaluates game outcomes based on pay table at step 642. The outcome evaluator 623 also includes a trigger monitor 623A which determines whether one or more trigger conditions are met. The trigger conditions are stored in memory 643. Each of the trigger conditions is associated with additional game play. For example, a feature game such as a jackpot game or free spins. Any winning outcomes are credited to win meter which is stored as meters 644. Meters also store the current wagers 644A in respect of the first set of reels and the second set of reels. The memory 64 also stores two different button layouts 645 for the display 54C. The two different button layouts 645 correspond to a one and a two player mode as described in further detail below. A mode controller 624 monitors the instructions input via the touch screen display 54C to determine whether to operate the gaming machine a single or two-player mode. The display controller 625 also includes a symbol hider 625A which hides or obscures certain symbols which are not active in certain uses of the single-player modes as described in further detail below.

Figure 9:
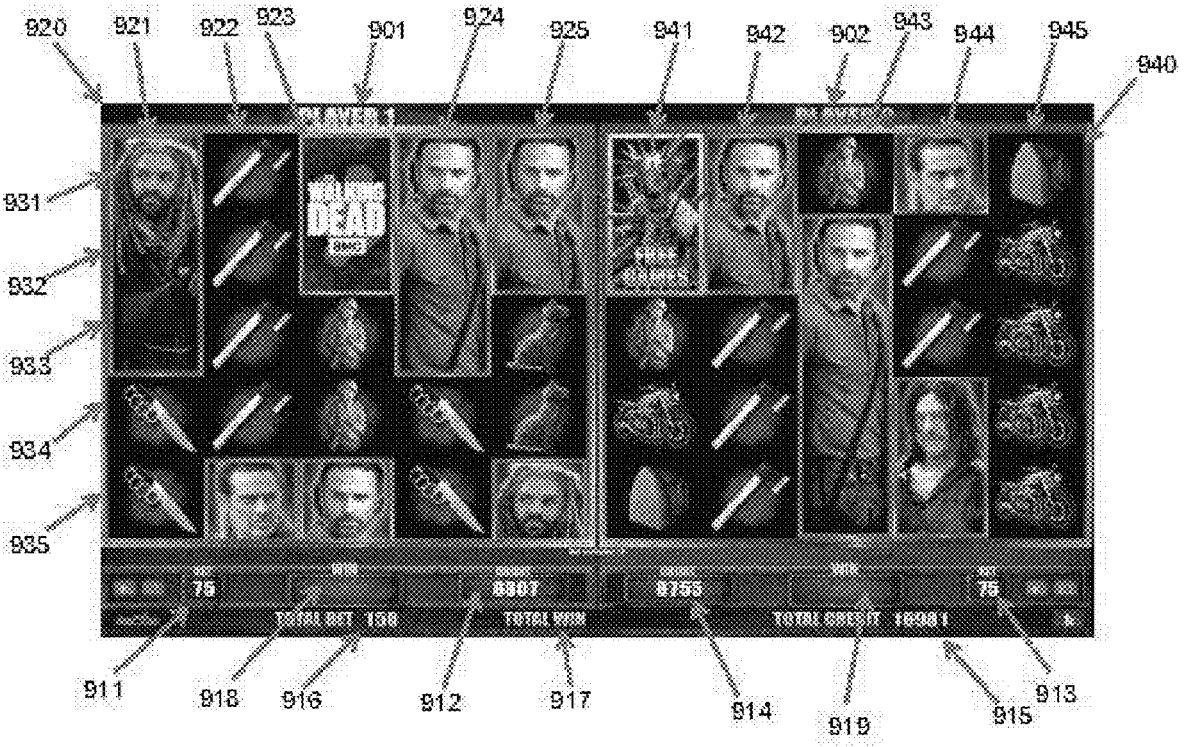
FIG. 9 is a screen shot of the gaming machine operating in a two-player mode.

The difference between the operation of the two-player mode and one-player mode is best understood by reference with the output on the displays during the respective modes. FIG. 9 shows an example screen shot displayed on the lower display 54B. From the screen shot, it can be seen that symbols selected from the first set of reels 920 are displayed in a first set of symbol display positions in a first plurality of columns 921, 922, 923, 924 and 925 and symbols from the second set of reels 940 are displayed in a second set of symbol display positions in a second plurality of columns of symbol display positions 941, 942, 943, 944. Text 901 indicates that player one plays the left set of symbol display positions (left set of reels) corresponding to the first set of reels 920 and player two 902 plays the right hand set of symbol display positions corresponding to the second set of reels 940. The symbols are displayed in five rows 931 to 935.

Figure 10:
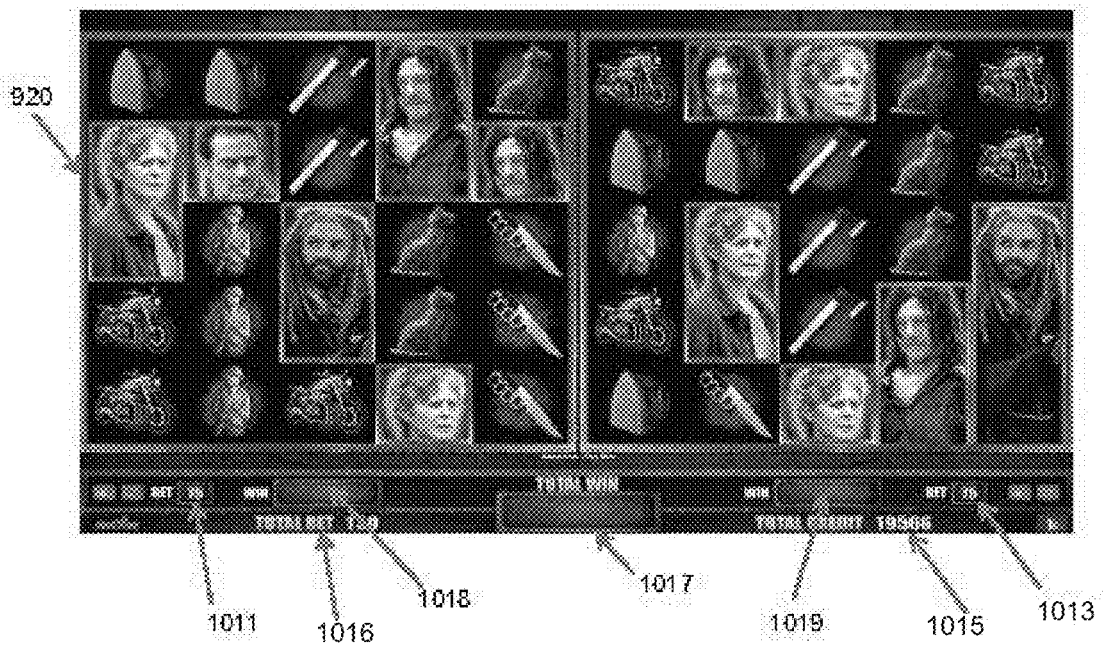
FIG. 10 is a screen shot of the gaming machine operating in a one-player mode with the player wagering seventy five (75) credits on both sets of columns of symbol display positions.

It will also be appreciated that the display 54B shows the amount bet 911 by the first player as seventy five (75) credits and the amount bet 913 by the second player as seventy five (75) credits. The display 54B also shows current credit balances 912, 914 for the first player and the second player, the total amount bet across both game instances 916 and the total credit in the gaming machine 915. As is apparent from FIG. 9, the first and second players can independently select the amount to wager on a game of the gaming machine in the two player mode (FIG. 9 shows an example where the players have elected the same wager amount). Each player can each select from a plurality of positive credit values, such as those shown in FIG. 6. As is also apparent, the appearance of the meters associated with the first and second reel sets is different between the one-player mode and two-player mode. Further, some meters that are associated with the respective sets of reels 920, 940 and some meters are associated with the both reel sets and the appearance of the meters associated with both reel sets as a whole also changes between the one-player mode and two-player mode. For example, FIG. 9 shows the current credit balances 912, 914 for each of the two players and as can be seen in FIG. 10, these are removed in the single player mode. Further, as shown in the FIG. 10, the total win meter 1017 is made more prominent than the total win meter 917 in FIG. 9.

FIG. 10 shows the first set of reels 920 and the second set of reels 940 in an example where the gaming machine is operating in a one-player mode. In this example, the single player has elected to place wagers having positive credit values of seventy five (75) credits on both the first set of reels 920 and the second set of reels 940 using touch-screen display 54C. The display shows that the player has bet seventy five (75) credits 1011 on the first set of reels 920 and seventy five (75) credits 1013 on the second set of reels but the player is able to select different amounts to wager on each set of reel. The display shows the total amount bet 1016 and the total credit 1015. That is, FIG. 10 shows that the player can bet on both game instances.

In this example, the outcome evaluator will evaluate both the first set of reels 920 and the second set of reels 940 for winning combinations based on the pay table and the respective amounts wagered on the two sets of reels 920, 940 and make any awards to the meters 644 (e.g. to a win meter). The meters store the current value of the wagers 644A independently for each of the first and second sets of symbols. That is, the meters include a first wager meter and a second wager meter.

Figure 11:
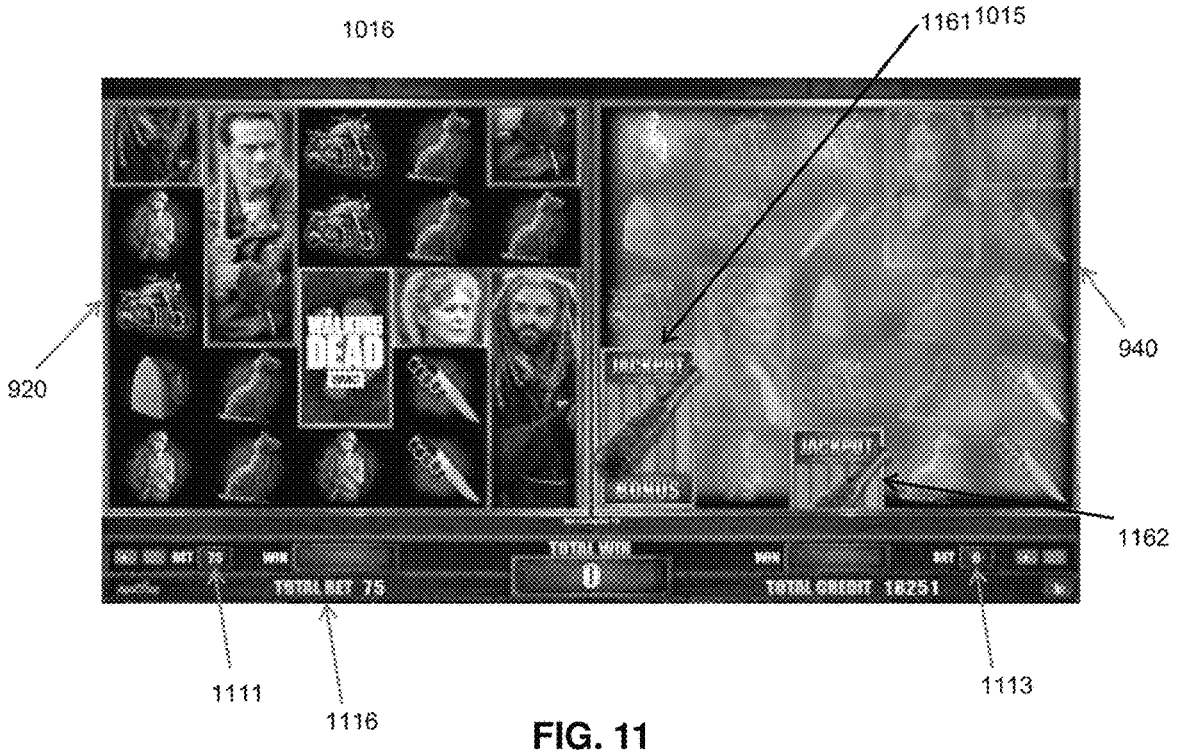
FIG. 11 is a screen shot of the gaming machine operating in a one-player mode with the player wagering seventy five (75) credits one set of columns of symbol display positions and 0 credits one the other set of columns of symbol display positions.

Turning now to FIG. 11, there is shown another example of the gaming machine operating in a one-player mode. In this example, the player has elected to bet seventy five (75) credits 1111 on the first set of reels 920 and 0 credits 1113 on the second set of reels 940. Thus, the total bet is seventy five (75) credits 1116.

Irrespective of the amount wagered per window, all the reels are spun in order to select symbols for display. As shown in FIG. 11, trigger symbols 1161 and 1162 are still treated as live symbols for the purpose of triggering additional game play for the first player even though the outcomes in the second set of reels will not be evaluated from the perspective of making an award of credits from the pay table while the remaining symbols are greyed out by symbol hider 625A which places a "mist" effect over the inactive symbols. That is, the player can wager 0 credits on the second game outcome yet the reels of the second set of reels will still be spun and certain symbols will be active and used in determining whether the player is entitled to additional game play such as a feature game. In an embodiment, the trigger condition is a defined number of the trigger symbols occurring on the first set of reels 920 or the second set of reels 940. In another embodiment, the trigger condition is a defined number of the trigger symbols occurring across both the first set of reels 920 and the second set of reels 940. The same trigger conditions can apply in both the one-player mode and the second-player mode. In an embodiment, when the trigger occurs in a one-player mode, a feature game is carried out on both the first set of reels 920 and the second set of reels 940 irrespective of the first player's wager. In an embodiment, the feature game on the second set of reels may be greyed-out if the first player has made a zero wager on the second set of reels to indicate that the first player will not receive an award.

In one arrangement, regardless of whether two game windows are activated for a single player or two respective players, the gaming machine is configured to display an anticipation reel-spinning sequence. The anticipation reel-spinning sequence includes time-extending reel spin on selective reels. The time-extended reel spin is displayed responsive to one or two game windows approaching a potential trigger condition. A potential trigger condition may be the occurrence of N of M required trigger symbols in the pair or each of the game windows, where N<M (e.g. N is 2 and M is 3), while one or more remaining reels are still being spun. In one embodiment, the anticipation reel-spinning sequence includes display of a first subset of corresponding spinning reels being stopped synchronously (e.g. at the same time or substantially the same time) across the two game windows, and subsequent display of a second subset of corresponding spinning reels being stopped asynchronously (e.g. at different times).

Figure 16:
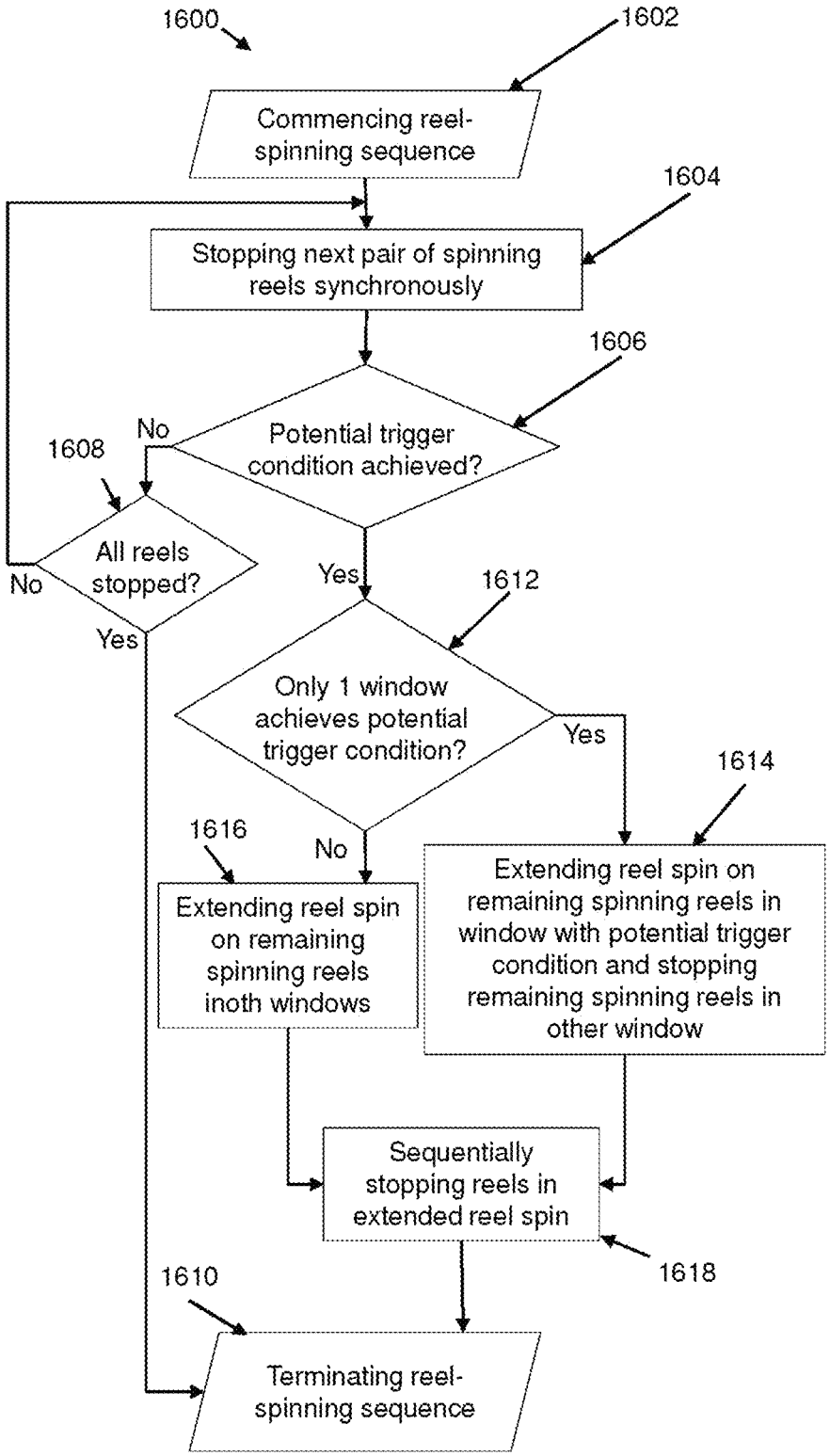
FIG. 16 shows a flow chart of the gaming machine displaying an anticipation reel-spinning sequence.

For example, as illustrated in FIG. 16, an anticipation reel-spinning sequence 1600 includes, at step 1602, commencing spinning of all reels of the two game windows. At step 1604, the next (e.g. first) pair of corresponding spinning reels (e.g. reels 1 and 6) are stopped synchronously. That is, there is a synchronization relationship between reels of the first and second windows which defines which of the reels will be spun together. At step 1606, it is determined whether a potential trigger condition is achieved in the last reel stop. If it is determined that a potential trigger condition is not yet achieved, it is then determined at step 1608 whether all reels are stopped, in which case the reel spinning sequence 1600 is terminated at step 1610, otherwise control returns to step 1604 for a next pair of synchronous reel stopping. For example, where no potential trigger condition is achieved through the reel-spinning sequence, reel 1 from the first game window 920 and corresponding reel 6 from the second game window 940 are stopped together after a regular-time reel spin (e.g. after the initial reel spin), reel 2 from the first game window 920 and corresponding reel 7 from the second game window 940 are stopped together after another regular-time reel spin (e.g. after the reels 1 and 6 are stopped), and so on across the 10 reels in two game windows. That is, in this example, each reel of the first game window 920 is paired with a reel in the second game window and where there is no potential trigger condition the pairs of reels are stopped at the same time. In comparison, where a potential trigger condition is achieved while remaining reels are being spun, (e.g. where 2 of 3 required trigger symbols have occurred) the gaming machine is configured to display a time-extended reel spin on one or more remaining spinning reels, with corresponding remaining spinning reels being stopped asynchronously. This configuration of time-extended reel spin and asynchronously stopping corresponding reels allows the player to focus on only one game window at a time while waiting to see if they complete a trigger condition in the respective window. A special sound such as a reel whir may be produced to accompany the time-extended reel spin.

In one example, potential trigger conditions can occur independently in each of the two windows. In this example, the display of the time-extended reel spin is dependent on whether either one or two game windows are approaching a potential trigger condition. If it is determined at step 1612 that a potential trigger condition has occurred in only one of the two game windows, at step 1614, remaining spinning reels of that window are each displayed with a time-extended reel spin, while all remaining spinning reels in the other game window (where there is no potential trigger condition) are stopped (e.g. simultaneously or sequentially at regular-time intervals). If it is determined that a potential trigger condition is achieved in each of the two game windows independently, then at step 1616, remaining spinning reels in both game windows are each displayed with a time-extended reel spin. In either scenario, at step 1618, the spinning reels on time-extended reel spin are stopped sequentially to complete the sequence 1600 at step 1610. The order in which the remaining spinning reels on time-extended reel spin are stopped sequentially at step 1618 may be from left to right. For example, where a trigger symbol occurs on each of stopped reels 1, 2, 6 and 7, the remaining spinning reels 3, 4, 5, 8, 9 and 10 may be each displayed with time-extended reel spin and stopped separately in that order. In this example, corresponding reels 1 and 6 are stopped synchronously after a regular-time reel spin, and corresponding reels 2 and 7 are stopped synchronously after another regular-time reel spin, but reels 3, 4, 5, 8 9 and 10 are stopped asynchronously. Alternatively, the order may be from right to left. In either case, the display of the time-extended reel spin changes from an independent spin mechanic in each game window (where none or only one of two game windows achieves a potential trigger condition) to a dependent mechanic that operates across both game windows at the same time (where only the two game windows both achieve a potential trigger condition). For example, in the case of a left-to-right sequential reel-stopping order, the remaining spinning reels in the second game window 940 are continually displayed as spinning while reel 6 is being stopped in the first game window 920, and only after the time-extended reel spin has completed in the first game window 920 are the remaining spinning reels in the second game window 940 stopped.

In another example, if it is determined that a potential trigger condition has occurred in only one of the two game windows after X reels have been stopped so that a time-extended reel spin is initiated in respect of the first window, a time-extended reel spin can be initiated in the second window if a trigger condition subsequently occurs in second window, (for example after X+1 reels have been stopped) to assist in recognition that a second trigger condition has occurred. In an example, the reels of the second window are still stopped before the reels of the first window but extended spinning is applied to further focus the player's attention on the second window.

In another example, a trigger condition of M symbols can occur across the multiple windows and a potential trigger condition can be N symbols, where N is less than M. In one example, there are two windows, the trigger condition is 4 trigger symbols and the potential trigger condition is 3 trigger symbols. A first pair of reels (one from each window) are spun to a stop synchronously (e.g. reels 1 and 6) and each has one trigger symbol such that 2 trigger symbols are displayed and the potential trigger condition is not met. A second pair of reels (reels 2 and 7) is spun to a stop and reel 7 has a further trigger symbol such that a potential trigger condition is met. Remaining spinning reels in both game windows are each displayed with a time-extended reel spin. The spinning reels on time-extended reel spin are stopped sequentially. The order in which the remaining spinning reels on time-extended reel spin are stopped sequentially may be from left to right. In this example, the remaining spinning reels 3, 4, 5, 8, 9 and 10 may be each displayed with time-extended reel spin and stopped separately in that order.

In another example, initial synchronous spinning of reels followed by asynchronous spinning when a potential trigger condition is met can be implemented in respect of more than two reel windows. For examples, 3 or 4 reel windows.

Figure 12:
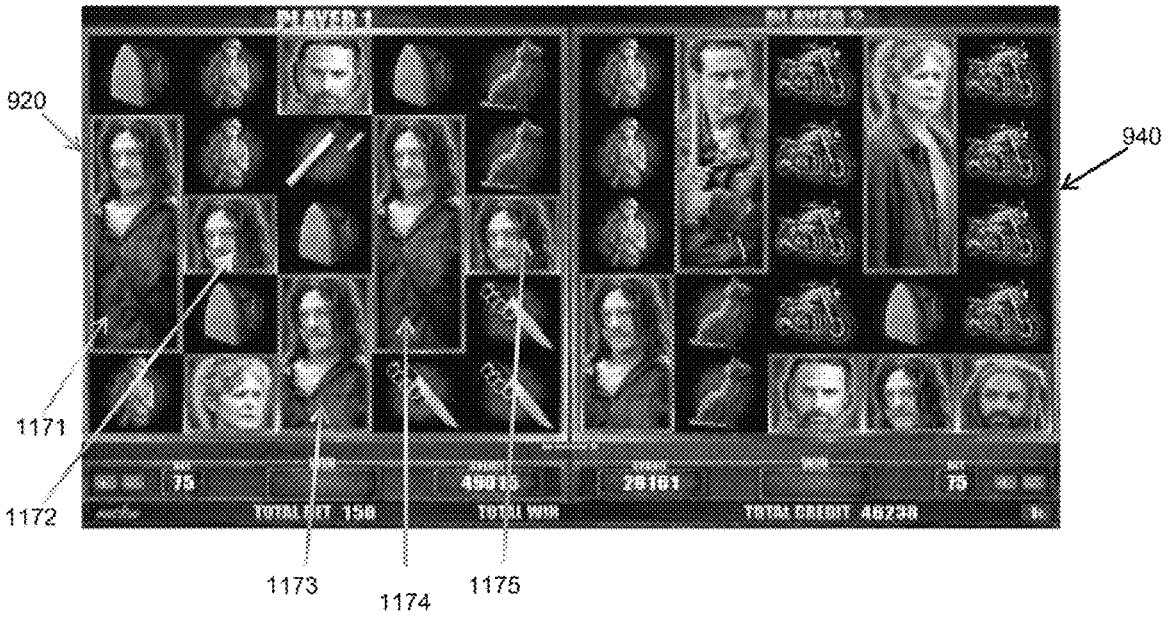
FIG. 12 is an exemplary display of a game outcome including oversized symbols.
Figure 13:
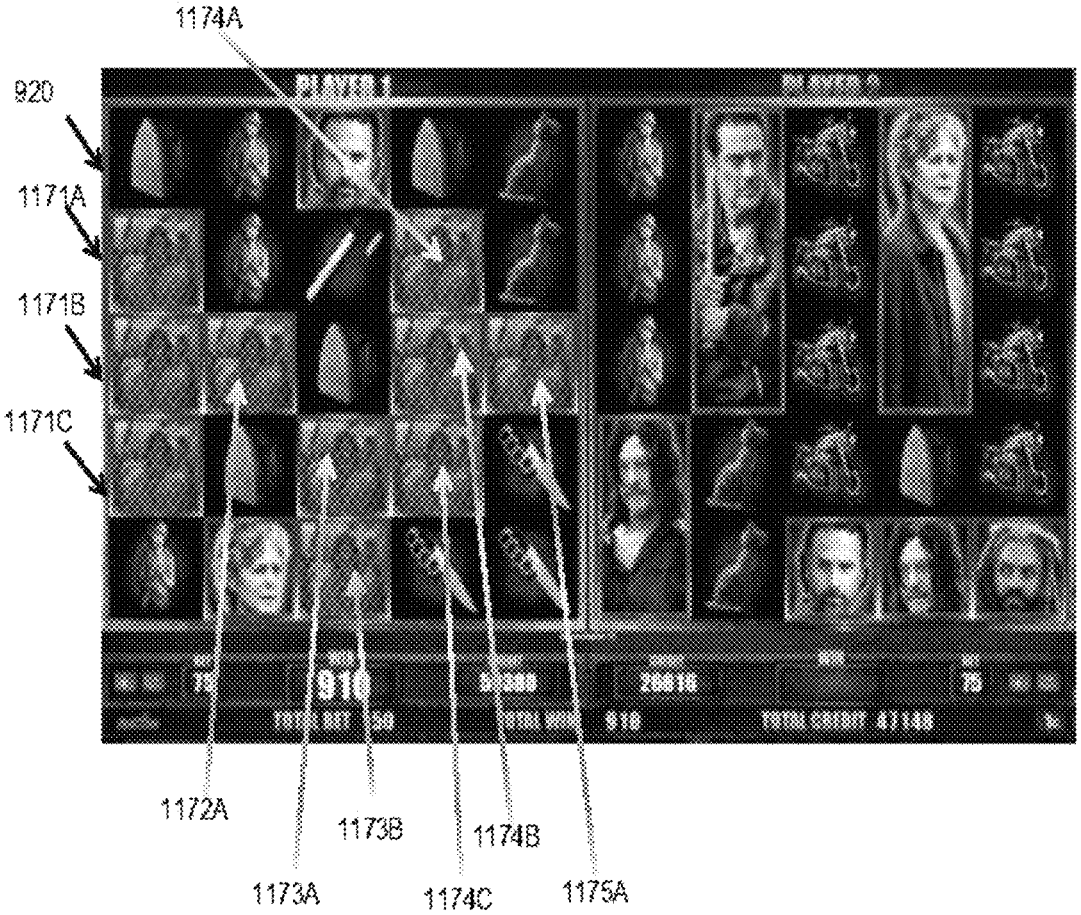
FIG. 13 shows the display of FIG. 12 modified to indicate how the oversized symbols are evaluated.

FIGS. 12 and 13 show the operation of the oversized symbols. The oversized symbols are those symbols which are displayed to occupy more than one symbol display position. Each oversized symbol may be stored in reel data 641 as a consecutive stack of identical symbols on one of the first set of reels 641A and the second set of reels 641B. FIG. 12 shows that the first set of reels 920 have spun up a first 3-by-1 symbol 1171 of a specific character, a second 3-by-1 symbol 1174 of the specific character, a 2-by-1 symbol 1173 of the specific character, a first 1-by-1 symbol 1172 of the specific character, and a second 1-by-1 symbol 1175 of the specific character.

FIG. 13 shows that when any one or more of these symbols forms part of a winning symbol combination on the first set of reels 920 the display of the symbol is changed to indicate that the symbols are evaluated as individual symbols. In this example this is achieved by displaying an alternative image of the same character as single symbols. Thus, the first 3-by-1 symbol 1171 of the specific character has been transformed into three single symbols 1171A, 1171B and 1171C. The first 1-by-1 symbol 1172 is transferred into transformed into symbol 1172A. The 2-by-1 symbol 1173 of the specific character is transformed into single symbols 1173A, 1173B. The second 3-by-1 symbol 1174 of the specific character is transformed into symbols 1174A, 1174B, 1174C and the second 1-by-1 symbol 1175 is transformed into symbol 1175A. In contrast, any other oversized symbols not forming part of a winning symbol combination (e.g. the oversized symbols in the first, second and fourth columns of the second game window 940) remain as oversized symbols without being transformed to individual symbols. The contrast provides a visual representation that more (or fewer) transformed symbols indicates more (or fewer) winning combination(s) being achieved. While FIGS. 12 and 13 illustrate, and corresponding description relates to, operation of oversized symbols spun up in the first set of reels 920, a skilled person would appreciate that the description is equally applicable to, with minor modifications, the second set of reels 940 as an alternative or additional operation.

Figure 8:
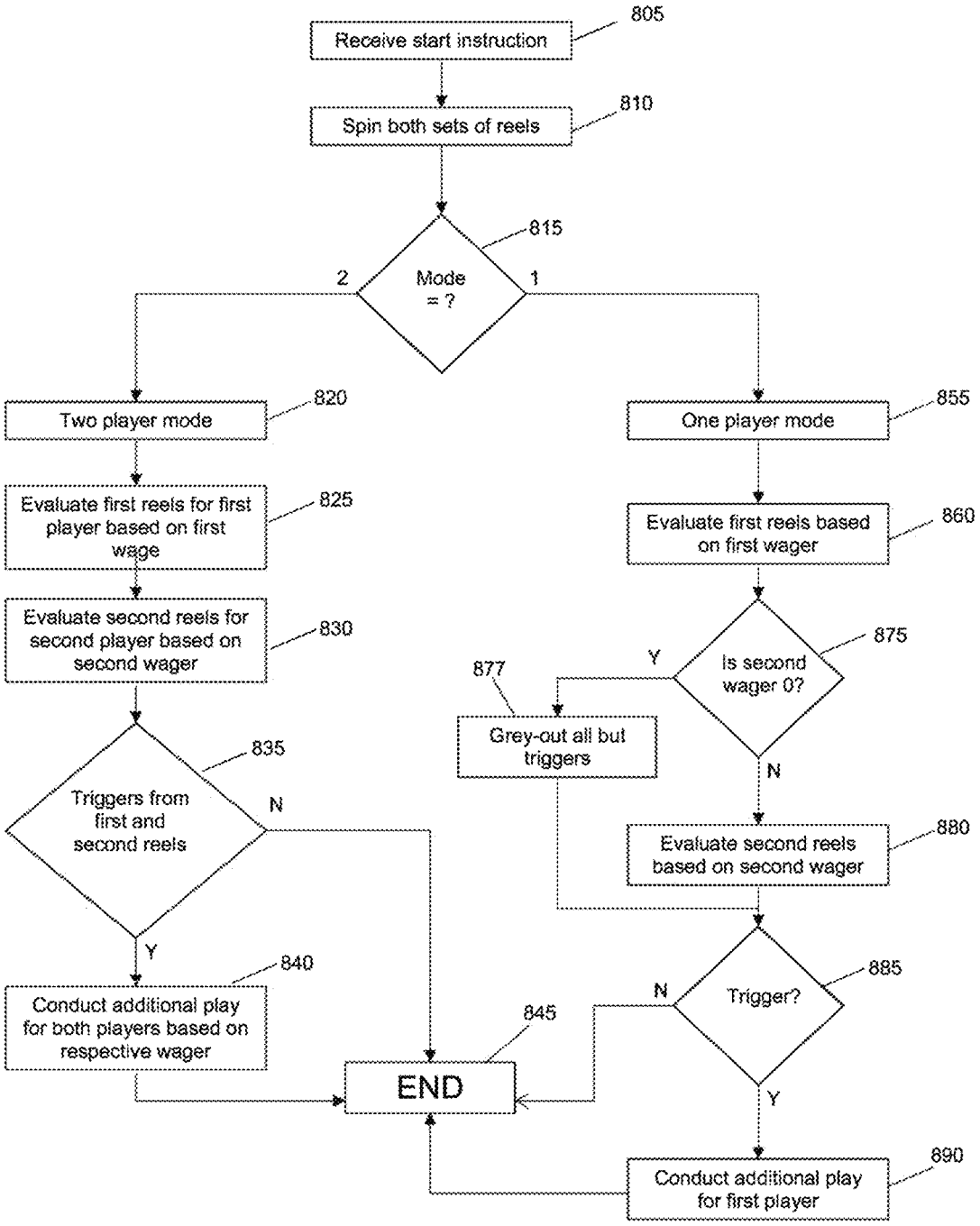
FIG. 8 is a flow chart of an embodiment.

FIG. 8 shows a method 800 of operating a gaming machine according to an embodiment of the disclosure. The method involves receiving start instruction 805 and spinning both sets of reels 810. A decision is made at step 815 as to whether the gaming machine is operating in the first player mode or the second player mode. When operating the two player mode at step 820 the method 800 of operating the gaming machine involves evaluating first reels at step 825 for a first player based on the first wager and evaluating the second reels at step 830 for the second player based on the second wager. Both these evaluations are performed using the pay table at step 642. The method then involves determining whether a trigger condition occurs 835 from the first and second reels in conducting additional play for both players based on their respective wagers 840 before the method ends 845.

In the one-player mode at step 855 the method involves evaluating at step 860 the first set of reels based on the first wager and determining at step 875 whether the second wager is 0 credits. If the second wager is not 0, the method involves evaluating the second reels based on the second wager at step 880. The method then involves determining whether a trigger has occurred across the first and second sets of reels at step 885 and conducting any additional play for the first player at step 890.

If at step 875 is determined that the second wager is 0, then the symbol hider 625A grays out all but the trigger symbols on the second set of reels at step 877. In some embodiments, this may be achieved by retrieving a different visual representation of the second reels from the memory 64 before controlling the display to display the symbols.

As indicated above, typically the additional game play will be in the form of a feature game. Persons skilled in the art will appreciate that a feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game.

An example of additional game play is to operate the gaming machine to conduct a game as described in Australian patent application 2017901012 filed 22 Mar. 2017 entitled "A GAMING MACHINE AND A METHOD OF OPERATING A GAMING MACHINE" where a first reel spins in a first direction (e.g. horizontally) and carries prizes and a set of second reels that spin in a second direction transverse to the first direction (e.g. vertically). Each of the second reels is aligned with a position at which one of the prizes of the first reel is displayed after the first reel stops spinning. Each of the reels of the set of second reels has a plurality of symbols including an index symbol. The reels of the set of second reels are spun at least once. When, after spinning of the second reels has finished, there are index symbols displayed on the second reels, these are used to define an index for evaluating the first reel. In an example, each of the prizes indexed by an index symbol is awarded to the player.

Another example of additional game play is conducted with a series of free games. During the free games a special set of reel strips are used that do not include the jackpot feature/free games trigger symbols so that it is not possible to trigger the features from within a free game.

Figure 14A:
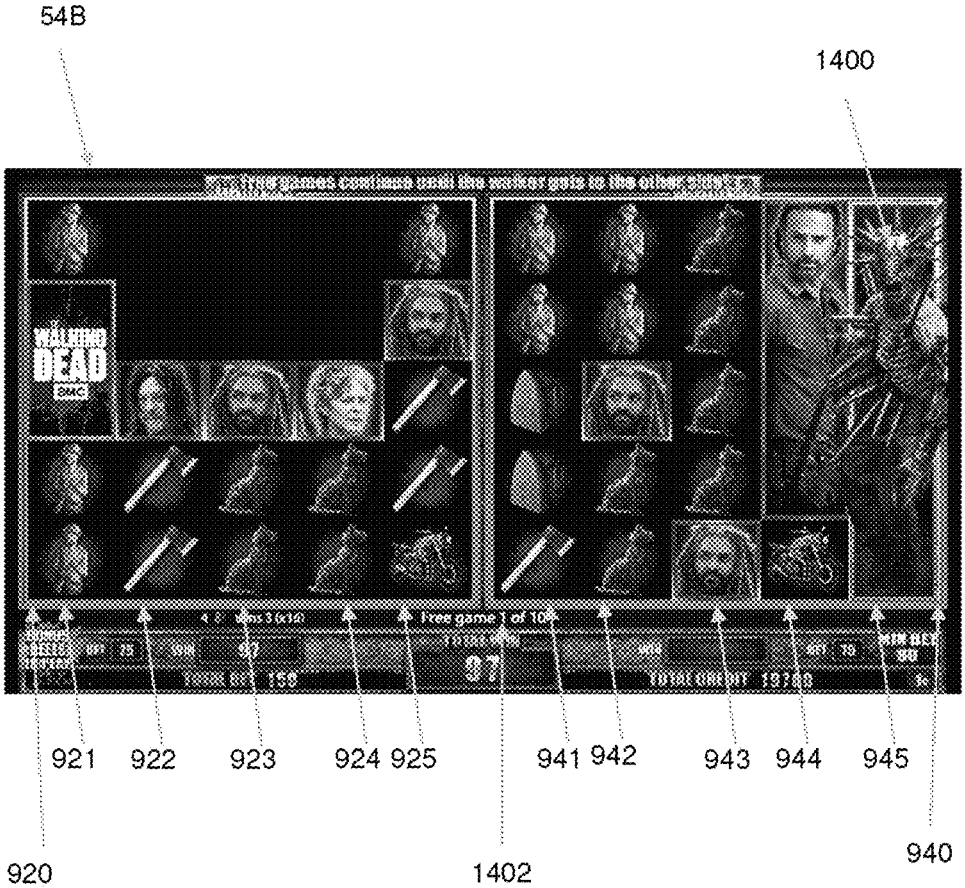
FIG. 14A to 14C are each a screen shot of the gaming machine operating during a series of free games.

In an example, as illustrated in FIG. 14A, in the first free game a special character 1400, such as an animated symbol, will enter the display 54B and occupy all symbol positions corresponding to the 10th reel 945 and remain in place for the duration of the first free game.

When the reels stop spinning all wins will be paid in accordance with the game paytable, and treating the special character 1400 as wild for all symbols on the last reel of a second game window corresponding to the second set of reels 940. Combinations that include the special character 1400 will, in effect, be paid as 5× the paytable win because they will occur 5 times due to the Reel Power evaluation method.

Figure 14B:
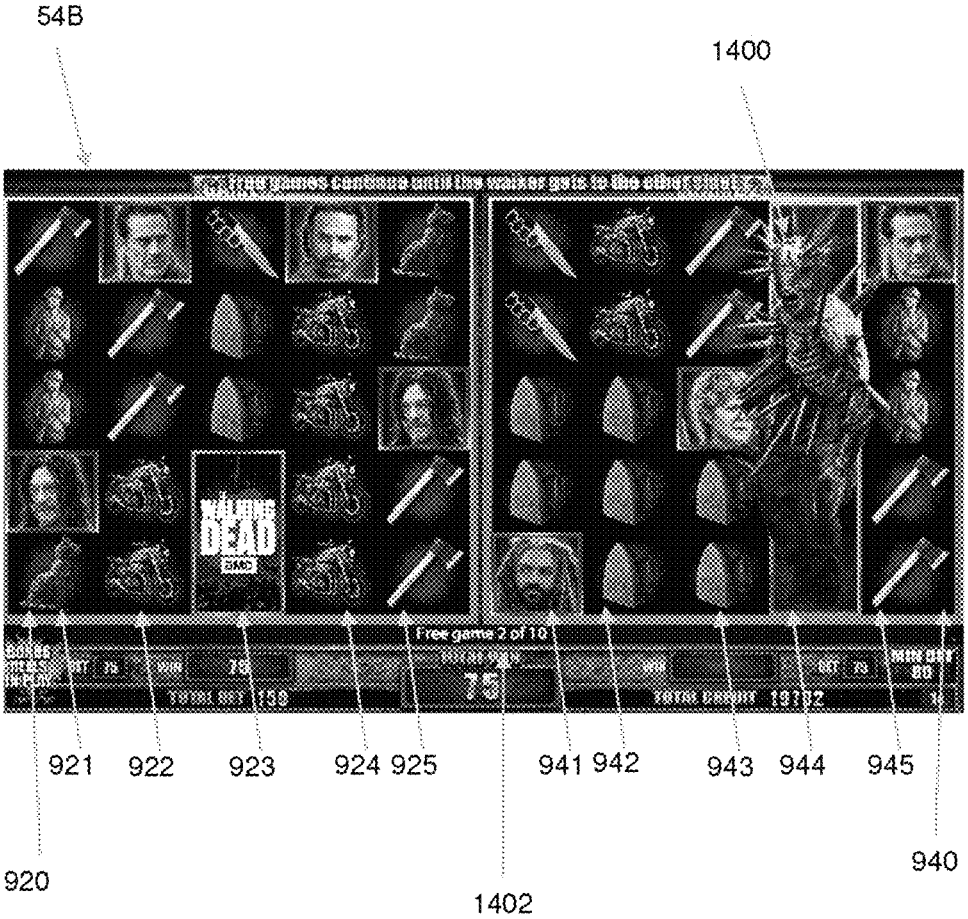
Figure 14C:
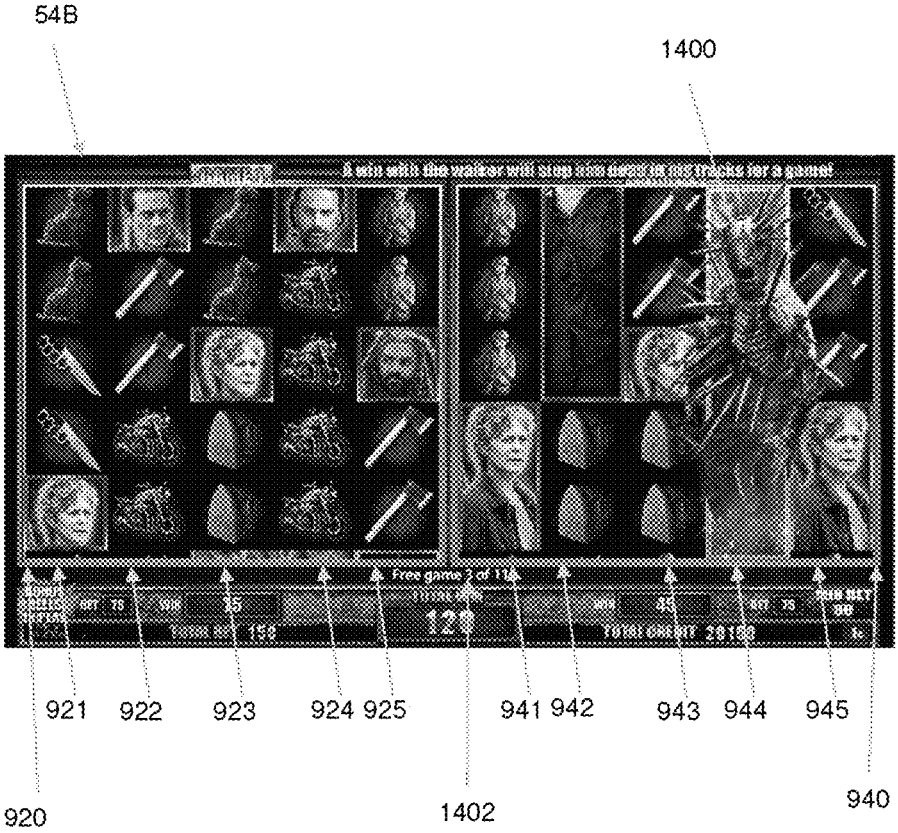
Figure 15:
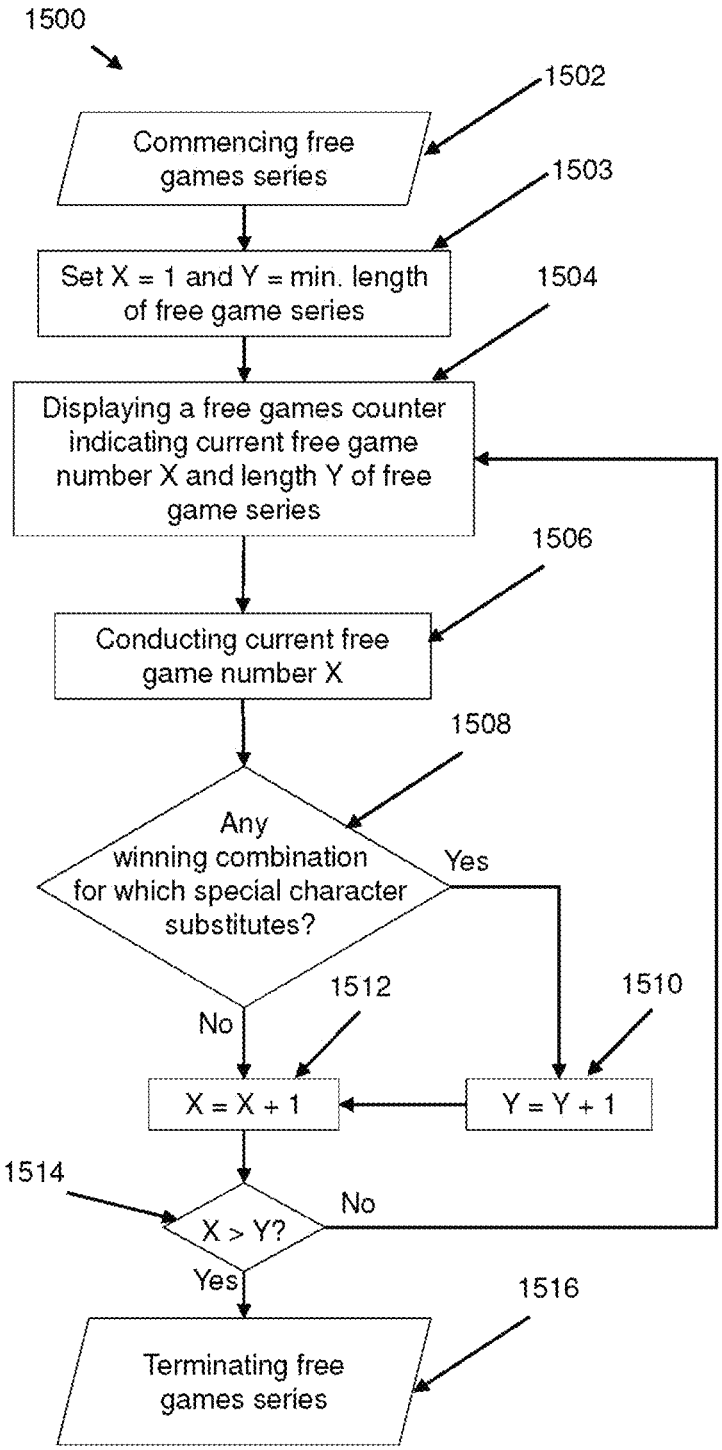
FIG. 15 shows a flow chart of the gaming machine conducting a series of free games.

If the outcome of the first free game is a winning combination for which the special character 1400 substitutes (even if there is no win paid due to the second game window corresponding to the second set of reels 940 being inactive due to a zero wager in the one-player mode) then the special character 1400 remains in the same position for the next free game, as illustrated in a transition from FIG. 14B to FIG. 14C. If there is no win combination with the special character substituting (i.e. being active) then the special character will animate to move to the next reel, i.e. initially from Reel 10 945 to Reel 9 944, as illustrated in a transition from FIG. 14A to FIG. 14B. In an example, if when the special character 1400 does not advance, an animation is displayed of another character pushing or attacking the special character to cause the special character to stay in place. In a variant, other conditions can cause the special character 1400 to move or not move (i.e. retain). In one example, the special character moves or stays put depending on whether a value of a win is above a threshold or based on a random determination as to whether the other character's attack is successful. After the special character 1400 has moved to the leftmost reel 921 and a subsequent free game is conducted, the series of free game continues if the outcome of that free game is a winning combination for which the special character 1400 substitutes, otherwise the series of free games terminates if the outcome of that free game is not a winning combination for which the special character 1400 substitutes. The last free game therefore occurs where the special character 1400 has moved to the leftmost reel 921 with a subsequent free game resulting in no win combination for the special character 1400 substitutes. At the termination of the series of free games, the special character 1400 is configured to exit the game window 920 from the leftmost reel 921.

As the movement of the character 1400 is dependent on conditions, the length of the series of free games is increasable from a minimum length. The minimum length of the series of free games equals the number of reels (e.g. 10 in the example of two game windows each associated with five reels). Occurrence of any winning combinations for which the special character 1400 substitutes in a free game increments the length of the free game series by one. In some instances, during the series of free games, the lower display 54B may be configured to display a free games counter 1402 to indicate the current free game number X and the length Y of the free game series, in accordance with a method 1500 of displaying a free games counter. The free games counter 1402 may display information in the form of "Free game X of Y" or "X of Y free games". The gaming machine commences at step 1502 the free game series. At the commencement of the free game series, at step 1503, X is set to 1, and Y is set to the minimum length (e.g. 5 in the example of a single activated game window associated with five reels, or 10 in the example of two activated game windows each associated with five reels). At step 1504, the lower display 54B is configured to display a free games counter 1402 indicating current free game number X and the length Y of free game series. Both X and Y are configured to be updated as the series of free games progresses. At step 1508, the gaming machine is configured to determine occurrence of any winning combination for which the special character 1400 substitutes. If one or more winning combinations for which the special character 1400 substitutes occur, Y is incremented by 1 at step 1510, and X is incremented by 1 at step 1512. Otherwise if no winning combinations for which the special character 1400 substitutes occur, step 1510 is bypassed, and X is incremented by 1 at step 1512. In some arrangements, Y is incremented by a number based on (e.g. equal to) the number of winning combinations for which the special character 1400 substitutes. In other words, X is incremented by one each time a subsequent free game is conducted, and Y is incremented by one or more for each winning combination for which the special character 1400 substitutes. At step 1514, if it is determined that X is greater than Y, the free game series is terminated at step 1516, otherwise the method 1500 returns to step 1504.

For example, in the first free game illustrated in FIG. 14A, the free games counter 1402 displays "Free game 1 of 10". In this example, in the first free game, no winning combination for which the special character 1400 substitute occurs. The free game series progresses to the second free game, as illustrated in FIG. 14B, with the free games counter 1402 displaying "Free game 2 of 10", incrementing X by 1 but not incrementing Y. The special character 1400 correspondingly moves to the 9th reel 944, responsive to a lack of any winning combination for which the special character 1400 substitutes. Further, in this example, a winning combination for which the special character 1400 substitutes occurs in the second free game. The free game series progresses to the third free game, as illustrated in FIG. 14C, with the free games counter 1402 displaying "Free game 3 of 11", incrementing each of X and Y by 1. The special character 1400 also retains in the 9th reel 944 responsive to occurrence of a winning combination for which the special character 1400 substitutes.

In this example, the special character 1400, acting as a wild column, is configured to move unidirectionally towards the left, such as moving across one reel per one or multiple free games from the rightmost reel to the leftmost reel, whereas symbols are evaluated for winning combinations from left to right. The rightmost reel may be the 10th reel, if both the first and second game windows 920 and 940 each associated with a set of five reels are active. Alternatively the rightmost reel may be the 5th reel, if only one of the two game windows 920 and 940 is active. For left-to-right symbol evaluations, a wild symbol closer to the left of the game window is more likely to result in a winning combination than a wild symbol closer to the right of the game window. The free game series configured for right-to-left wild column movement in left-to-right symbol evaluations therefore achieves probabilistically more winning combinations in later spins than earlier spins of the free game series. Conversely, for right-to-left symbol evaluations, a wild symbol closer to the right of the game window is more likely to result in a winning combination than a wild symbol closer to the left of the game window. Free game series configured for left-to-right wild column movement in right-to-left symbol evaluations may achieve probabilistically more winning combinations in later spins than earlier spins of the free game series. Further, the increase in the probability of achieving a winning combination in later spins, in turn, probabilistically lengthens the free game series by more likely retaining the special character in later spins than earlier spins.

Therefore, as the free game series progresses, the probability of winning increases to heighten anticipation. In arrangements where two instead of one game windows are activated, the anticipation heightens twice, with a lowered anticipation in between. For example, where each game window is associated with a set of 5 reels, the anticipation heightens as the special character 1400 moves from the 10th reel towards the 6th reel, then decreases as the special character 1400 moves from the 6th reel to the 5th reel, and heightens again as the special character 1400 moves from the 5th reel towards the 1th reel. Accordingly, wild column movement over consecutive free games in opposite direction to symbol evaluation probabilistically increases the likelihood of winning over the consecutive free games. Further, while movement of a wild column to a next reel corresponds an increased likelihood of achieving a winning outcome, whereas retainment of the wild column in a reel corresponds to one or more additional free games.

If the second game window is inactive due to the trigger bet being '0' on the second window in single player mode then it remains inactive for the duration of the free games. However the special character still moves across the reels in the same fashion even though wins will not be paid in the inactive window.

The free game win is paid with win celebration tier structure exactly as per the base game except that the free game custom rollups and tunes will play instead of the base ones for each tier.

The same process is repeated for every free game with the special character moving to the next reel if no special character substitute wins occur or staying where it is if there is a special character win.

The series of free games continue until the special character is on reel 1 and no win occurs with the special character substituting after which the series of free games completes.

Persons skilled in the art, will appreciate that while this feature game is advantageous in the context of a gaming machine that functions in one-player or two-player mode, it could be implemented in other gaming machines which are only operable by a single player. For example, in a gaming machine where as a default the player plays two windows of reels.

A winning outcome will result in an award being made such as an award of credits based on the pay table. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

For example, an aspect of the disclosure provides a method of operating an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a pay table defining awards for winning combinations of symbols applicable to each of the first and second sets of columns of symbol display positions; and a plurality of buttons including first buttons to enable a first wager to be selected from one of a first plurality of different positive credit value wager amounts, the first wager applying to symbols displayed in the first set of columns of symbol display positions, and second buttons to enable a second wager amount to be selected from a zero amount and one of a second plurality of positive credit value wager amounts, the second wager applying to symbols displayed in the second set of columns of symbol display positions, the method comprising controlling, irrespective of the wagers applied to each of the first and second sets of columns, each reel of the first and second sets of reels to spin to a respective stop position to thereby select, at the conclusion of the spinning, symbols that fill the columns of symbol display positions; evaluating the symbols displayed in the first set of columns of symbol display positions based on the pay table and the first wager, and make any awards for winning combinations of symbols; and evaluating the symbols displayed in the second set of columns of symbol display positions based on the pay table and the second wager, and make any awards for winning combinations of symbols, wherein a zero wager amount results in no award.

In an embodiment, the method comprises: evaluating the symbols displayed in the first and second sets of columns of symbol display positions to determine whether a trigger condition is met; and upon the trigger condition being met, conducting additional game play corresponding to the trigger condition.

In another aspect, the disclosure provides an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a pay table defining awards for winning combinations of symbols applicable to each of the first and second sets of columns of symbol display positions; a plurality of buttons including first buttons to enable a first wager to be selected from one of a plurality of different first wager amounts, the first wager applying to symbols displayed in the first set of columns of symbol display positions, and second buttons to enable a second wager amount to be selected from a plurality of second wager amounts, the second wager applying to symbols displayed in the second set of columns of symbol display positions; and a game controller configured to: control, irrespective of the wagers applied to each of the first and second sets of columns, each reel of the first and second sets of reels to spin to a respective stop position to thereby select, at the conclusion of the spinning, symbols that fill the columns of symbol display positions; evaluate the symbols displayed in the first set of columns of symbol display positions based on the pay table and the first wager, and make any awards for winning combinations of symbols; evaluate the symbols displayed in the second set of columns of symbol display positions based on the pay table and the second wager, and make any awards for winning combinations of symbols; evaluate the symbols displayed in the first and second sets of columns of symbol display positions to determine whether a trigger condition is met; and upon the trigger condition being met, conduct additional game play corresponding to the trigger condition.

In yet another aspect, the disclosure provides a method of operating an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; and a memory storing a pay table defining awards for winning combinations of symbols applicable to each of the first and second sets of columns of symbol display positions; and a plurality of buttons including first buttons to enable a first wager to be selected from one of a plurality of different first wager amounts, the first wager applying to symbols displayed in the first set of columns of symbol display positions, and second buttons to enable a second wager amount to be selected from a plurality of second wager amounts, the second wager applying to symbols displayed in the second set of columns of symbol display positions, the method comprising controlling, irrespective of the wagers applied to each of the first and second sets of columns, each reel of the first and second sets of reels to spin to a respective stop position to thereby select, at the conclusion of the spinning, symbols that fill the columns of symbol display positions; evaluating the symbols displayed in the first set of columns of symbol display positions based on the pay table and the first wager, and make any awards for winning combinations of symbols; evaluating the symbols displayed in the second set of columns of symbol display positions based on the pay table and the second wager, and make any awards for winning combinations of symbols; evaluating the symbols displayed in the first and second sets of columns of symbol display positions to determine whether a trigger condition is met; and upon the trigger condition being met, conducting additional game play corresponding to the trigger condition.

In still another aspect, the disclosure provides an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a) a pay table defining awards for winning combinations of symbols applicable to each of the first and second sets of columns of symbol display positions, and b) a plurality of meters; and a game controller configured to operate in a one-player mode or a two-player mode responsive to at least one instruction input to the gaming machine, control the display to display at least a subset of the meters, and respond to switching between the one-player mode and the two-player mode by changing the display of the at least a subset of the meters on the display.

In an embodiment, the controller changes the appearance of at least one of the meters.

In an embodiment, the controller adds at least one meter or removes at least one meter from the meters displayed on the display.

In yet another aspect, the disclosure provides a method of operating an electronic gaming machine comprising: a first set of reels corresponding to a first set of columns of symbol display positions, each first reel comprising a plurality of symbols of a symbol set; a second set of reels corresponding to a second set of columns of symbol display positions, each second reel comprising a plurality of symbols of the symbol set; a memory storing a) a pay table defining awards for winning combinations of symbols applicable to each of the first and second sets of columns of symbol display positions, and b) a plurality of meters, the method comprising: operating in a one-player mode or a two-player mode responsive to at least one instruction input to the gaming machine, controlling the display to display at least a subset of the meters, and responding to switching between the one-player mode and the two-player mode by changing the display of the at least a subset of the meters on the display.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the disclosure that many modifications may be made without departing from the spirit and scope of the disclosure, in particular it will be apparent that certain features of embodiments of the disclosure can be employed to form further embodiments. Further, while some configurations are directed to a two-player mode operation, they may well be operable by a single player, for example, via an additional wager placed by the single player to provide game play instructions to activate two game windows. As another example, where configurations are directed to two activated game windows of analogous operation, the configurations may alternatively be operated with one activated game window. Accordingly, description hereinafter referring to a two-player mode operation and/or two game windows is also applicable, with minor modifications, to a single-player mode operation and/or one game window.

It is to be understood that, if any prior art is referred to herein, such reference does not constitute an admission that the prior art forms a part of the common general knowledge in the art in any country.

In the claims which follow and in the preceding description of the disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the disclosure.

The invention claimed is:

1. An electronic gaming machine comprising:

a video display;

a memory storing a first set of columns of symbol display positions, and an evaluation direction of the first set of columns of symbol display positions that defines an evaluation order from a first evaluated column to a last evaluated column of the first set of columns of symbol display positions;

a game controller, configured to execute instructions stored in the memory, which, when executed by the game controller, cause the game controller to at least:

initially control the video display to display a special symbol occupying a plurality of symbol positions of the last evaluated column; and during each free game in a series of free games:

evaluate symbols selected including the special symbol, a current position of the special symbol, and the evaluation order, for a winning outcome, in response to determining that the special symbol not contributing to the winning outcome, move the special symbol to an adjacent column on the video display in a direction opposite to the evaluation direction towards the first evaluated column, and retain the special symbol at the adjacent column for evaluation in a subsequent free game in the series of free games, and in response to evaluating that the special symbol contributing to the winning outcome, retain the special symbol on the video display for evaluation at the current position in the subsequent free game in the series of free games.

2. The electronic gaming machine as claimed in claim 1, wherein the special symbol is a wild symbol.

3. The electronic gaming machine as claimed in claim 1, wherein the memory stores a second set of columns of symbol display positions comprising a different first evaluated column to a different last evaluated column of the second set of columns of symbol display positions, and wherein the game controller is caused to at least:

display on the video display the second set of columns of symbol display positions next to the first set of columns of symbol display positions; and move the special symbol on the video display across both the first set of columns of symbol display positions and the second set of columns of symbol display positions such that the special symbol is moved from the first evaluated column of the first set of columns of symbol display positions to the different last evaluated column of the second set of columns of symbol display positions.

4. The electronic gaming machine as claimed in claim 1, wherein the instructions, when executed, further cause the game controller to move the special symbol based on a length of the series of free games.

5. The electronic gaming machine as claimed in claim 1, wherein the instructions, when executed, further cause the game controller to move the special symbol unidirectionally.

6. The electronic gaming machine as claimed in claim 1, wherein the instructions further cause the game controller to initially control the video display to display the special symbol occupying the plurality of symbol positions of the last evaluated column, in response to one or more outcomes from a random number generator.

7. A method of operating a gaming machine comprising a video display and a game controller comprising a memory, the memory stores for a first set of columns of symbol display positions and an evaluation direction of the first set of columns of symbol display positions that defines an evaluation order from a first evaluated column to a last evaluated column of the first set of columns of symbol display positions, the method comprising:

initially displaying on the video display a special symbol occupying a plurality of symbol positions of the last evaluated column; and during each free game in a series of free games:

evaluating symbols selected including the special symbol, a current position of the special symbol, and the evaluation order, for a winning outcome, in response to evaluating that the special symbol not contributing to the winning outcome, moving on the video display the special symbol to an adjacent column in a direction opposite to the evaluation direction towards the first evaluated column, and retain the special symbol at the adjacent column for evaluation in a subsequent free game in the series of free games, and in response to evaluating that the special symbol contributing to the winning outcome, retaining the special symbol on the video display for evaluation at the current position in the subsequent free game.

8. The method of operating the gaming machine as claimed in claim 7, wherein the memory stores a second set of columns of symbol display positions comprising a different first evaluated column to a different last evaluated column of the second set of columns of symbol display positions, and wherein the method further comprises:

displaying on the video display the second set of columns of symbol display positions next to the first set of columns of symbol display positions; and moving the special symbol on the video display across both the first set of columns of symbol display positions and the second set of columns of symbol display positions such that the special symbol is moved from the first evaluated column of the first set of columns of symbol display positions to the different last evaluated column of the second set of columns of symbol display positions.

9. The method of operating the gaming machine as claimed in claim 7, wherein the special symbol is a wild symbol.

10. The method of operating the gaming machine as claimed in claim 7, wherein moving the special symbol is dependent on a length of the series of free games.

11. The method of operating the gaming machine as claimed in claim 7, wherein the special symbol moves unidirectionally.

12. The method of operating the gaming machine as claimed in claim 7, further comprising initially controlling the video display to display the special symbol occupying the plurality of symbol positions of the last evaluated column, in response to one or more outcomes from a random number generator.

13. A non-transitory computer-readable medium for conducting a game on an electronic gaming machine comprising a video display and a game controller comprising a processor and a memory storing a) for a first set of columns of symbol display positions and an evaluation direction of the first set of columns of symbol display positions that defines an evaluation order from a first evaluated column to a last evaluated column of the first set of columns of symbol display positions, and b) instructions, which, when executed cause the processor to perform at least the steps of:

initially displaying on the video display a special symbol occupying a plurality of symbol positions of the last evaluated column; and during each free game in a series of free games:

evaluating symbols selected including the special symbol, a current position of the special symbol, and the evaluation order, for a winning outcome, in response to evaluating that the special symbol not contributing to the winning outcome, moving on the video display the special symbol to an adjacent column in a direction opposite to the evaluation direction towards the first evaluated column, and retain the special symbol at the adjacent column for evaluation in a subsequent free game in the series of free games, and in response to evaluating that the special symbol contributing to the winning outcome, retaining the special symbol on the video display for evaluation at the current position in the subsequent free game.

14. The non-transitory computer-readable medium of claim 13, wherein the special symbol is a wild symbol.

15. The non-transitory computer-readable medium of claim 13, wherein the memory stores a second set of columns of symbol display positions comprising a different first evaluated column to a different last evaluated column of the second set of columns of symbol display positions, and wherein the instructions, when executed, further causes the processor to perform the steps of:

displaying on the video display the second set of columns of symbol display positions next to the first set of columns of symbol display positions; and moving the special symbol on the video display across both the first set of columns of symbol display positions and the second set of columns of symbol display positions such that the special symbol is moved from the first evaluated column of the first set of columns of symbol display positions to the different last evaluated column of the second set of columns of symbol display positions.

16. The non-transitory computer-readable medium of claim 13, wherein the instructions, when executed, further causes the processor to perform the step of initially controlling the video display to display a special symbol occupying the plurality of symbol positions of the last evaluated column, in response to one or more outcomes from a random number generator.

17. The non-transitory computer-readable medium of claim 13, wherein the instructions, when executed, further causes the processor to perform the step of moving the special symbol based on a length of the series of free games.

18. The non-transitory computer-readable medium of claim 13, wherein the instructions, when executed, further causes the processor to perform the step of moving the special symbol unidirectionally.

* * * * *